US009328517B2

(12) United States Patent
Bilge

(10) Patent No.: US 9,328,517 B2
(45) Date of Patent: May 3, 2016

(54) SYSTEM FOR MOUNTING WALL PANELS TO A SUPPORTING STRUCTURE

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

(21) Appl. No.: 14/251,992

(22) Filed: Apr. 14, 2014

(65) Prior Publication Data

US 2015/0292215 A1 Oct. 15, 2015

(51) Int. Cl.
*E04F 13/08* (2006.01)
*E04F 13/12* (2006.01)

(52) U.S. Cl.
CPC ..... *E04F 13/0803* (2013.01); *E04F 13/083* (2013.01); *E04F 13/0889* (2013.01); *E04F 13/0891* (2013.01); *E04F 13/12* (2013.01)

(58) Field of Classification Search
CPC . E04F 13/0889; E04F 13/0814; E04F 13/081; E04F 13/0805; E04F 13/0823; E04F 13/0826; E04F 13/083; E04F 13/12; E04F 13/0891; E04F 13/0803
See application file for complete search history.

(56) References Cited

U.S. PATENT DOCUMENTS

| | | | | |
|---|---|---|---|---|
| 1,655,406 | A | | 1/1928 | Bennett |
| 1,726,500 | A | | 8/1929 | Norris |
| 1,738,469 | A | | 12/1929 | Weiss |
| 1,833,174 | A | | 11/1931 | Norris |
| 2,054,573 | A | | 9/1936 | Mendenhall |
| 2,059,483 | A | | 11/1936 | Parsons |
| 2,066,205 | A | | 12/1936 | Keating |
| 2,082,241 | A | | 6/1937 | Bennett |
| 2,116,530 | A | * | 5/1938 | McCabe ..... 52/506.08 |
| 2,145,469 | A | * | 1/1939 | Weinland ..... 52/403.1 |
| 2,607,971 | A | | 8/1952 | Bedford, Jr. |
| 2,789,321 | A | | 4/1957 | Adams |
| 2,803,321 | A | | 8/1957 | Fox-Williams |
| 3,021,915 | A | | 2/1962 | Kemp |
| 3,548,557 | A | | 12/1970 | Downing, Jr. |
| 3,671,061 | A | | 6/1972 | Dawdy |
| 3,832,820 | A | | 9/1974 | Eggert |
| 3,858,377 | A | | 1/1975 | Browne et al. |
| 4,332,119 | A | | 6/1982 | Toews |

(Continued)

FOREIGN PATENT DOCUMENTS

| | | | | |
|---|---|---|---|---|
| CH | 353159 | A | * | 3/1961 |
| DE | 3326054 | A1 | | 6/1984 |

(Continued)

OTHER PUBLICATIONS

Bamco Inc., G500 Wall System., printed on Dec. 8, 2005.

(Continued)

*Primary Examiner* — Charles A Fox
*Assistant Examiner* — Charissa Ahmad
(74) *Attorney, Agent, or Firm* — Lerner, David, Littenberg, Krumholz & Mentlik, LLP

(57) ABSTRACT

A system for mounting a plurality of wall panels to a supporting structure includes a plurality of fasteners. The wall panels include a main panel and at least one L-shaped end section. Each of the fasteners include a base section having spaced apart walls providing an opening therebetween. Opposing U-shaped sections are arranged coupled to the first and second walls generally facing each other. A securing section is arranged outwardly of one of the U-shaped sections for attaching the fastener to a supporting structure. The U-shaped sections respectively receive a portion of an L-shaped end section of adjacent wall panels.

18 Claims, 48 Drawing Sheets

(56) References Cited

U.S. PATENT DOCUMENTS

| | | | |
|---|---|---|---|
| 4,344,267 | A | 8/1982 | Sukolics |
| 4,452,029 | A | 6/1984 | Sukolics |
| 4,573,300 | A | 3/1986 | Bezner |
| 4,640,064 | A | 2/1987 | Goodworth, II |
| 4,667,579 | A | 5/1987 | Daw |
| 4,696,142 | A | 9/1987 | Mieyal et al. |
| 4,829,740 | A | 5/1989 | Hutchison |
| 4,833,839 | A | 5/1989 | Kurose |
| 4,833,858 | A | 5/1989 | Hutchison |
| 4,998,395 | A | 3/1991 | Bezner |
| 5,050,360 | A | 9/1991 | Gailey |
| 5,263,292 | A | 11/1993 | Holland et al. |
| 5,579,624 | A | 12/1996 | Aeberhard |
| 5,644,878 | A | 7/1997 | Wehrmann |
| 5,809,729 | A | 9/1998 | Mitchell |
| 5,996,301 | A | 12/1999 | Conterno |
| 6,035,598 | A | 3/2000 | Sukolics et al. |
| 6,101,777 | A | 8/2000 | Bodine et al. |
| 6,164,024 | A | 12/2000 | Konstantin |
| 6,205,733 | B1 | 3/2001 | LaLonde |
| 6,330,772 | B1 | 12/2001 | Mitchell et al. |
| 6,430,885 | B1 | 8/2002 | Ito |
| 6,536,175 | B2 | 3/2003 | Conterno |
| 6,745,527 | B1 | 6/2004 | Sherman et al. |
| 6,748,709 | B1 | 6/2004 | Sherman et al. |
| 6,751,916 | B1 | 6/2004 | Ritzer et al. |
| 6,892,500 | B2 | 5/2005 | Zaborowski |
| 7,210,273 | B2 | 5/2007 | Zahner, II |
| 7,472,521 | B2 | 1/2009 | Bilge |
| 7,562,504 | B2 | 7/2009 | Herbst et al. |
| 7,562,509 | B2 | 7/2009 | Ness |
| 7,621,084 | B2 | 11/2009 | Bilge |
| 7,716,891 | B2 | 5/2010 | Radford |
| 7,752,818 | B1 | 7/2010 | Roegge et al. |
| 8,033,066 | B2 | 10/2011 | Griffiths |
| 8,056,289 | B1 | 11/2011 | Konstantin |
| 8,127,507 | B1 | 3/2012 | Bilge |
| 8,166,716 | B2 | 5/2012 | Macdonald et al. |
| 8,225,572 | B2 | 7/2012 | Wallace |
| 8,256,181 | B2 | 9/2012 | Voegele, Jr. et al. |
| 8,307,607 | B2 | 11/2012 | Conterno |
| 8,316,609 | B2 | 11/2012 | Ben-Zvi |
| 8,347,569 | B1 | 1/2013 | McIntyre et al. |
| 8,584,424 | B2 | 11/2013 | Smith et al. |
| 8,650,827 | B2 | 2/2014 | Givoni et al. |
| 2001/0022058 | A1 | 9/2001 | Conterno |
| 2002/0035811 | A1 | 3/2002 | Heuel |
| 2002/0152704 | A1 | 10/2002 | Thompson et al. |
| 2003/0110726 | A1 | 6/2003 | Rudduck |
| 2004/0134143 | A1 | 7/2004 | Boyer |
| 2006/0179744 | A1* | 8/2006 | Lynch et al. ..... 52/235 |
| 2007/0119105 | A1* | 5/2007 | MacDonald et al. ..... 52/235 |
| 2008/0155917 | A1 | 7/2008 | Bilge |
| 2009/0031645 | A1* | 2/2009 | Smith ..... 52/127.6 |
| 2009/0049770 | A1 | 2/2009 | Konstantin |
| 2009/0145071 | A1 | 6/2009 | Radford |
| 2009/0241444 | A1 | 10/2009 | Griffiths |
| 2009/0241451 | A1 | 10/2009 | Griffiths |
| 2009/0272055 | A1* | 11/2009 | Griffiths ..... 52/309.3 |
| 2010/0037549 | A1* | 2/2010 | Lynch et al. ..... 52/506.08 |
| 2010/0186343 | A1* | 7/2010 | MacDonald et al. ..... 52/747.1 |
| 2010/0287858 | A1 | 11/2010 | Israeli et al. |
| 2012/0017530 | A1* | 1/2012 | Hummel, III ..... 52/506.05 |
| 2012/0085042 | A1* | 4/2012 | Macdonald et al. ..... 52/173.3 |

FOREIGN PATENT DOCUMENTS

| | | | |
|---|---|---|---|
| DE | 3732534 | A1 | 4/1989 |
| DE | 3732535 | A1 | 4/1989 |
| EP | 2166169 | A1 | 3/2010 |
| GB | 2135355 | A | 8/1984 |
| JP | 8189176 | | 7/1996 |
| WO | WO 2008055320 | A1 * | 5/2008 |

OTHER PUBLICATIONS

International Search Report & Written Opinion for Application No. PCT/US2014/012496 dated May 22, 2014.

* cited by examiner

SYSTEM FOR MOUNTING WALL PANELS TO A SUPPORTING STRUCTURE

BACKGROUND OF THE INVENTION

The present disclosure relates generally to a wall panel system, and more particularly, to a system and components therefore for easily mounting wall panels over an existing supporting structure such as a wall.

In order to enhance the look of a wall structure, it is known to secure decorative wall panels to the wall structure. However, the securement of wall panels to the wall structure is generally a long and tedious job since it entails using fastening devices such as nails and/or screws to secure the walls panels directly to the wall structure. In addition, the fastening devices are exposed, which can provide an unsightly appearance.

One system for mounting wall panels to an existing structure is sold by Bamco Inc. of 30 Baekeland Ave., Middlesex, N.J. 08846 under the designation AG500 WALL SYSTEM. With this system, the wall panels are provided with right angle or bends at their edges. Each planar panel and the right angle bend together form an L-shape. Each bend is secured by screws to a fastening extrusion having the same linear dimension as the wall panel. At each joint area where two panels meet, there are two fastening extrusions connected together, each secured to a respective wall panel, with an elongated hard silicone gasket between the fastening extrusions. The fastening extrusions are arranged one above the other at each joint area.

A further system is known from Creative Metal Contractors Inc. of Toms River, N.J., which uses a single fastening extrusion having tongues extending from opposite sides thereof. The fastening extrusion is secured to the existing wall by screws at a central portion between the tongues. Each wall panel has a main panel section and hook walls at edges of the main panel section, with the main panel section and each hook wall having a U-shaped cross-sectional profile. Fasteners are secured to the hook walls, with each fastener including walls defining a recess which receives a corresponding tongue of the fastening extrusion, such that the tongues are spaced away from the hook walls. A compressed joint plug is positioned in overlying relation to the screws and between adjacent hook walls.

The present application addresses the deficiencies in known systems by disclosing a system and component parts therefore that are easy to assemble for mounting wall panels in a matrix over existing supporting structures such as building walls.

SUMMARY OF THE INVENTION

In accordance with an aspect of the present disclosure, a fastener for attaching a wall panel to a supporting structure comprises a base section having first and second spaced apart upstanding walls forming a first opening therebetween; a first U-shaped section arranged at the first wall having a second opening facing the second wall; a second U-shaped section arranged at the second wall having a third opening facing the first wall, and a securing section arranged outwardly of the second U-shaped section adapted for attaching the fastener to a supporting structure.

In another aspect of the present disclosure, a fastener for attaching a wall panel having L-shaped end sections to a supporting structure comprises a base section having first and second spaced apart upstanding walls forming a first opening therebetween; a first U-shaped section integrally coupled to the first wall and having a second opening facing the second wall, the second opening arranged above the first opening in communication therewith, the second opening configured to receive a portion of an L-shaped end section of a wall panel; a second U-shaped section integrally coupled to the second wall and having a third opening facing the first wall, the third opening arranged above the first opening in communication therewith, the third opening configured to receive a portion of another L-shaped end section of another wall panel; and a securing section integrally coupled to the second U-shaped section adapted for attaching the fastener to a supporting structure; wherein the first U-shaped section and the first upstanding wall form a fourth opening underlying the second opening; and the second U-shaped section and the second upstanding wall form a fifth opening underlying the third opening.

In accordance with a further aspect of the present disclosure, a fastener for attaching a wall panel having L-shaped end sections to a supporting structure comprises a base section having an upstanding wall at an end thereof forming a step; and a U-shaped section integrally coupled to the upstanding wall, the U-shaped section having a first opening facing the base section, the U-shaped section and the upstanding wall forming a second opening underlying the first opening; wherein the first opening is configured to receive a portion of an L-shaped end section of a wall pane; and the base section and the U-shaped section comprising a one-piece integral member.

In accordance with another aspect of the present disclosure, a system for mounting a plurality of wall panels to a supporting structure, comprises a plurality of wall panels including a main panel and at least one L shaped end section arranged at a right angle to the main panel; a plurality of fasteners for attaching a plurality of wall panels to a supporting surface, the fasteners including a base section having first and second spaced apart upstanding walls forming a first opening therebetween; a first U shaped section arranged at the first wall having a second opening facing the second wall, the second opening configured to receive a portion of an L shaped end section of a wall panel; a second U shaped section arranged at the second wall having a third opening facing the first wall, the third opening configured to receive a portion of an L shaped end section of another wall panel, and a securing section arranged outwardly of the second U shaped section adapted for attaching the fastener to a supporting structure.

BRIEF DESCRIPTION OF THE DRAWINGS

The above and other features of the disclosure will become readily apparent from the following detailed description thereof which is to be read in connection with the accompanying drawings, wherein.

DETAILED DESCRIPTION

Figure 1:
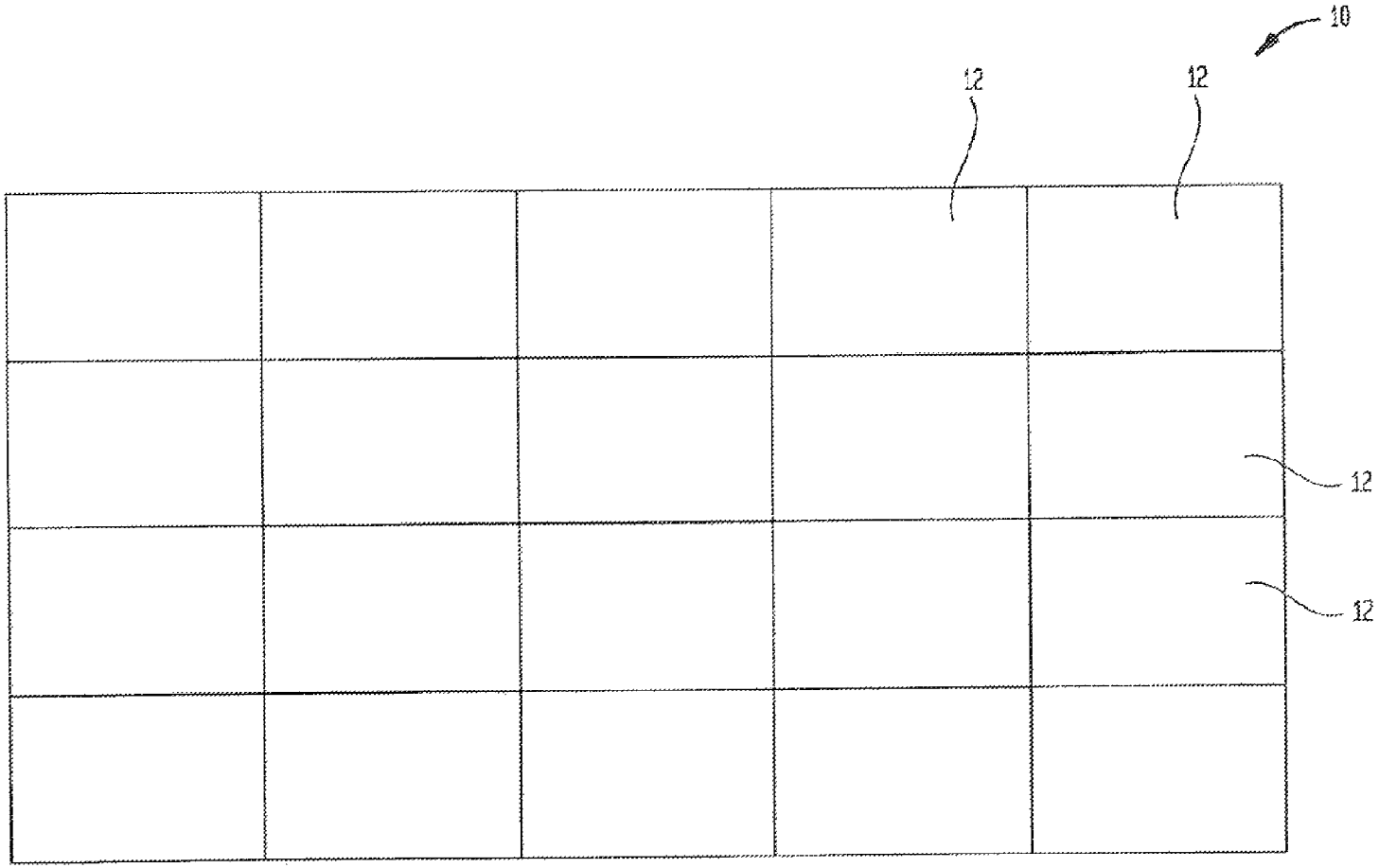
FIG. 1 is an elevational view of a plurality of wall panels mounted to an existing wall structure.

Referring to the drawings in detail, there is shown a system 10 according to the present invention for easily mounting wall panels 12 over an existing wall structure 14. Wall structure 14 preferably includes any planar wall. Each panel 12 includes a rectangular shaped, planar main panel section 16 and at least two bent end sections 18 bent at a right angle in the same direction at edges of main panel section 16. Main panel 16, however, need not be planar, and in fact, can have different shapes, such as a wave shape, etc. to provide different aesthetic appearances. Preferably, there are four bent end sections 18 at each edge of main panel section 16 which form an L-shaped cross-sectional shape thereat. However, the invention is not limited thereby and wall panels 12 can be formed with two, three or four bent end sections 18. Wall panels 12 are formed preferably by, but not limited to, a polyethylene core 20 with a thin aluminum wall covering opposite sides thereof, as shown in FIG. 5. However, for the sake of simplicity in the drawings, FIGS. 3 and 4 show wall panels 12 formed of only a single material.

Figure 2:
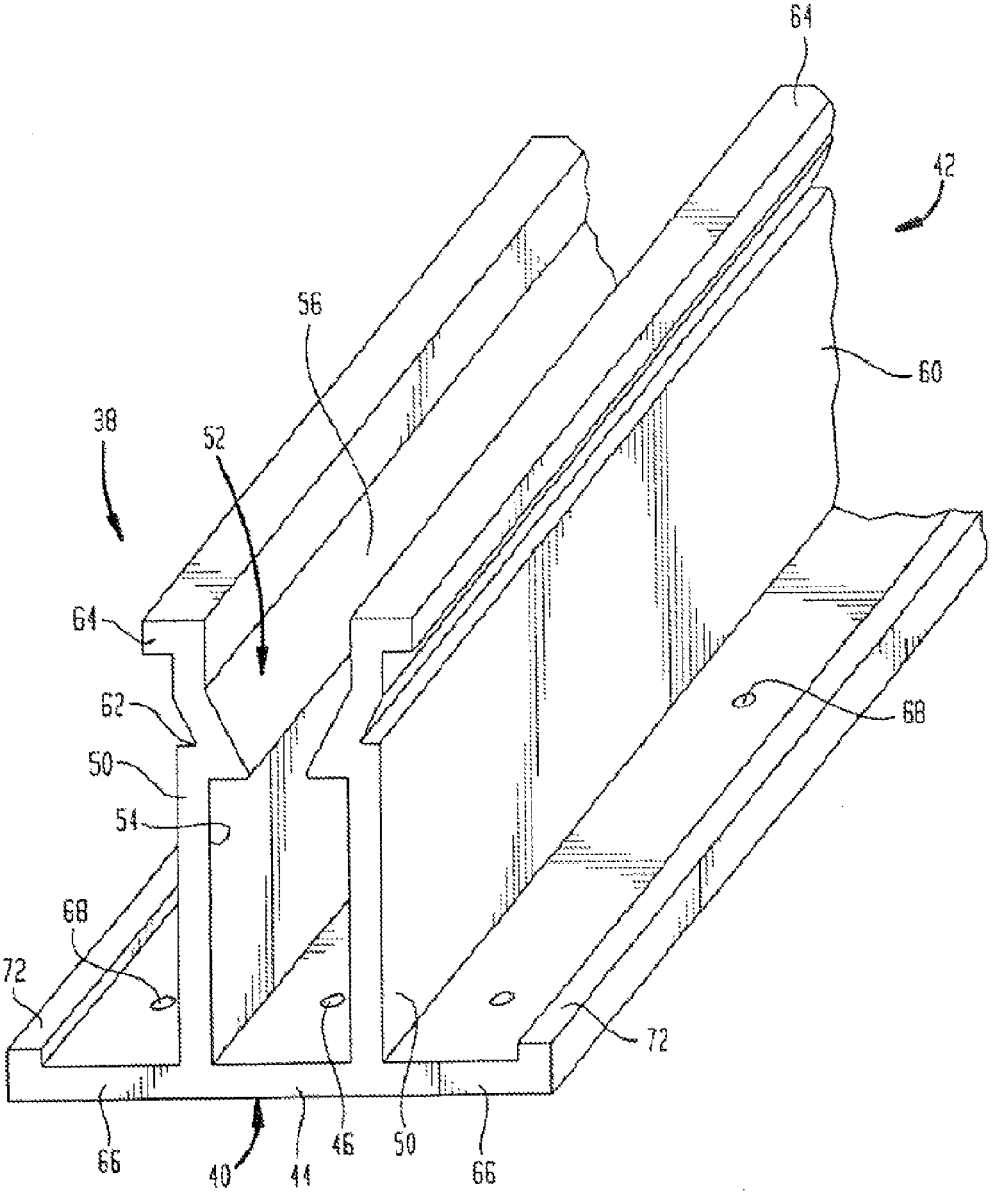
FIG. 2 is a perspective view of a frame extrusion according to the present invention.
Figure 4:
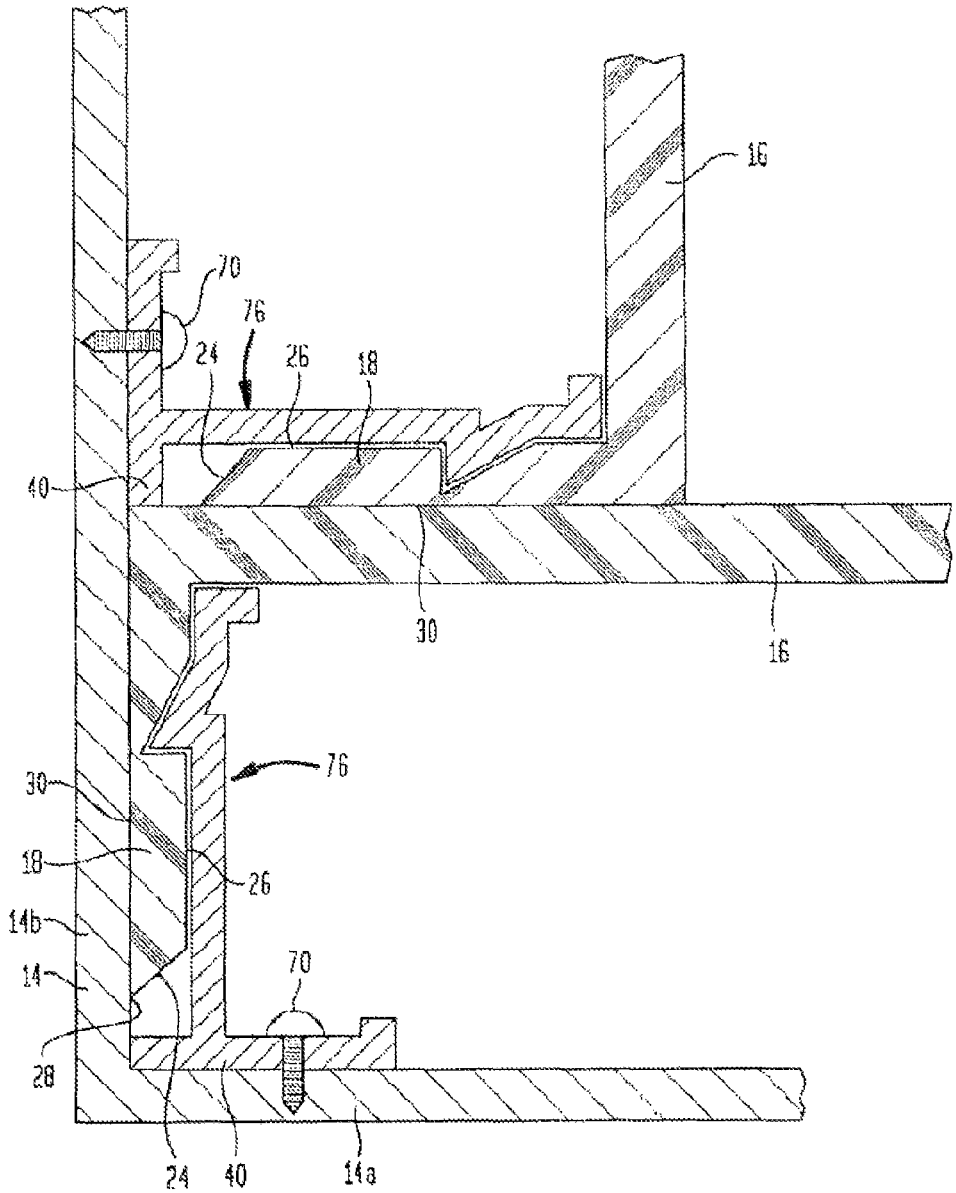
FIG. 4 is a cross-sectional view showing two wall panels connected together by a corner frame extrusion.
Figure 5:
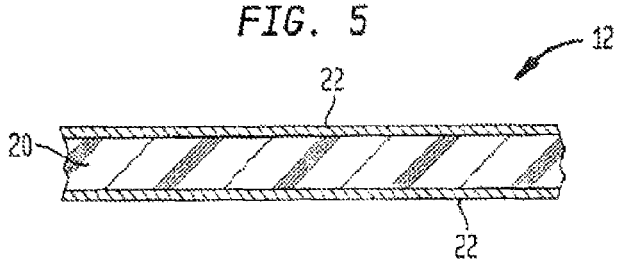
FIG. 5 is a cross-sectional view of a wall panel.

As shown in FIGS. 2 and 4, each bent end section 18 is formed with a lower beveled or inclined surface 24 at the inner surface 26 thereof and extending to a line edge 28 at the distal end of the bent end section 18 at the outer surface 30 thereof. As a result, there is a reduction in thickness of the bent end section 18 at the lower end thereof. Lower beveled surface 24 preferably extends along the entire length of the bent end section 18, although the present invention is not so limited, that is, lower beveled surface 24 can extend along only a part of the length of bent end section 18.

In addition, each bent end section 18 includes a cut-out section or recess 32 at the inner surface 26 thereof and spaced slightly away from main panel section 16. Each cut-out section 32 preferably has a nose-shaped configuration in cross-section, although the present invention is not limited thereby. Specifically, each cut-out section 32 has an inclined surface 34 that extends toward the distal end of the bent end section 18 at the outer surface 30 thereof, and terminates at a holding surface 36 that extends parallel to main panel section 16. As a result, cut-out section 32 effectively forms a notch in the inner surface of bent end section 18. Cut-out section 32 preferably extends along the entire length of the bent end section 18, although the present invention is not so limited, that is, cut-out section 32 can extend along only a part of the length of bent end section 18, or there may be a plurality of spaced apart cut-out sections 32.

Figure 3:
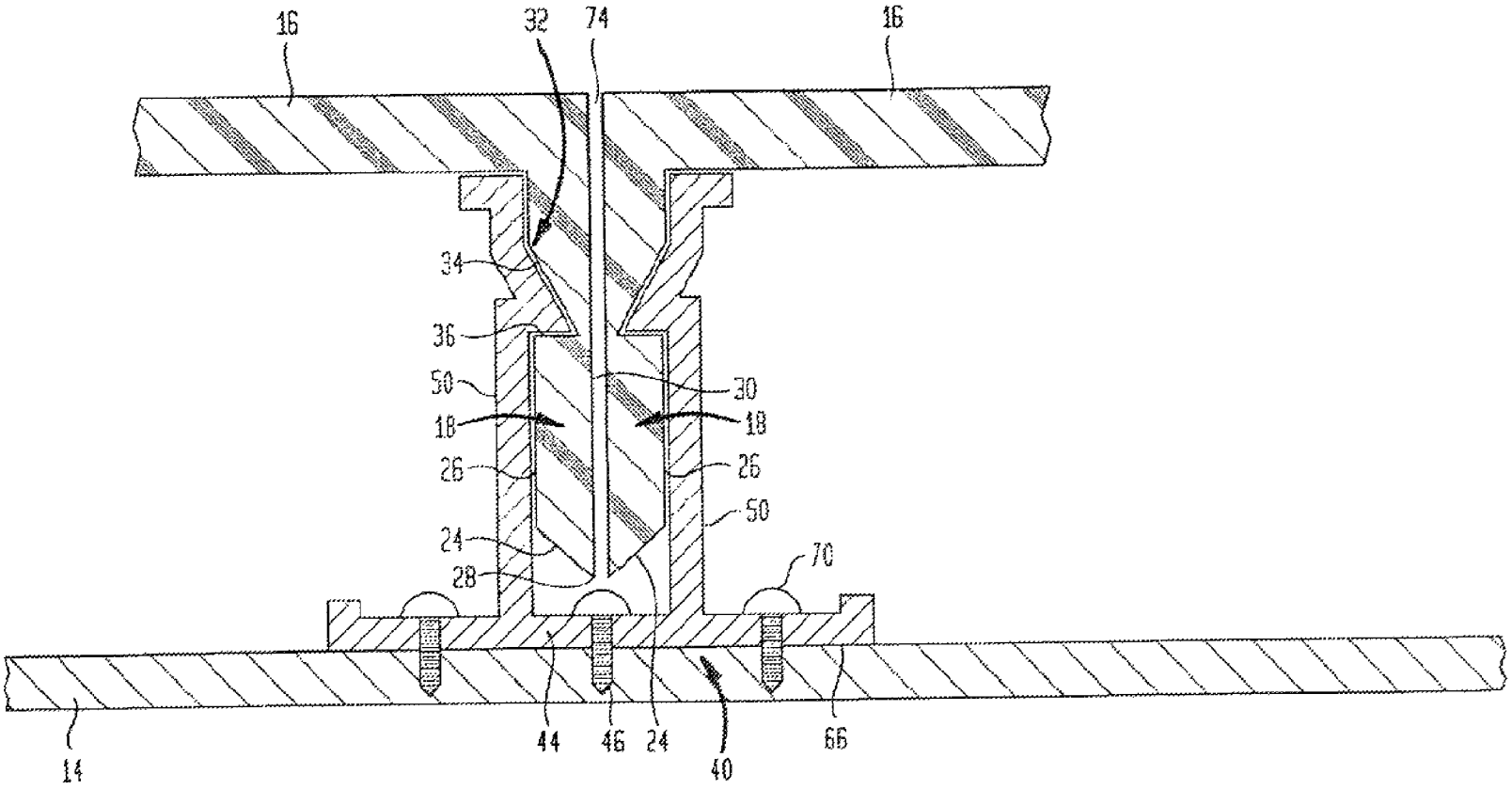
FIG. 3 is a cross-sectional view showing two wall panels connected together by the frame extrusion of FIG. 2.

As shown in FIGS. 2 and 3, main fastening extrusions 38 are provided for securing each wall panel 12 to existing wall structure 14. Each main fastening extrusion 38 is preferably formed as a single, one-piece, unitary member that includes a base section 40 secured to existing wall structure 14 and a supporting section 42 that connects to a side edge of each panel 12. Each main fastening extrusion 32 is formed preferably by a relatively rigid PVC (polyvinyl chloride) or chloroethylene homopolymer compound, which is a polyvinyl resin, but is not limited thereto, preferably a PVC material sold by the PVC Compound Division of Axiall, LLC of Madison, Miss. under the product names 2000 through 3999 and 5000 through 9999 pellet and powder, having a specific gravity in the range of 1.25 to 1.55. PVC material is very easy to cut or notch on a job site, saving time and labor.

Base section 40 includes a central planar wall 44 that seats flush against existing wall structure 14, and which has a plurality of linearly aligned openings 46 extending therealong and through which screws 48 can be inserted to secure central wall panel 44 to existing wall structure 14. Two, parallel, spaced apart, bent end securing walls 50 extend outwardly at right angles from opposite ends of central planar wall 44 for securing bent end sections 18 of two adjacent wall panels 12 thereto. As will be understood from the discussion hereafter, bent end securing walls 50 are flexible and resilient, so that they can be bent away from each other and when the bending force is removed, return to their original positions shown in FIGS. 2 and 3. In other words, although they are made of a relatively rigid PVC that can support heavy wall panels weighing more than 100 pounds, bent end securing walls 50 are still resilient and capable of flexing to accommodate the fitting of the wall panels therewith.

Each bent end securing wall 50 includes an inwardly directed projection 52 at the inner surface 54 of the respective bent end securing wall 50, with each projection having a nose-shaped configuration in cross-section, which corresponds in shape and dimensions to nose-shaped cut-out section 32, although the present invention is not limited thereby. Specifically, each projection 52 has an inclined surface 56 that slopes in a direction toward base section 40 and terminates at a holding surface 58 that extends parallel to central planar wall 44. Projection 52 preferably extends along the entire length of the bent end securing wall 50, although the present invention is not so limited, that is, projection 52 can extend along only a part of the length of bent end securing wall 50, or there may be a plurality of spaced apart projections 52.

As shown in FIGS. 2 and 3, the outer surface 60 of each bent end securing wall 50 includes a nose-shaped cut-out section 62 corresponding in position to nose-shaped projection 52, in order to save material, although the present invention is not limited thereby, and nose-shaped cut-out section 62 can be eliminated.

The upper free end of each bent end securing wall 50 includes an outwardly extending stub wall 64 that is perpendicular to the respective bent end securing wall 50 and parallel to central planar wall 44.

In addition, although not essential to the present invention, two outwardly extending wing walls 66 extend outwardly from opposite ends of central planar wall 44, that is, outwardly and extending from opposite sides of the lower ends of bent end securing walls 50. Each wing wall 66 is coplanar with central planar wall 44 so as to lie flush against existing wall structure 14, and each wing wall 66 includes a plurality of linearly aligned openings 68 extending therealong and through which screws 70 can be inserted to secure central wall panel wing walls 66 to existing wall structure 14. This provides additional securement of main fastening extrusions 38 to existing wall structure 14. Each wing wall 66 terminates in a bent end stub wall 72, although the present invention is not limited thereby.

With this arrangement, main extrusions 38 are secured to existing wall structure 14 by screws 46 and 70 at predetermined spacing intervals determined by the dimensions of wall panels 12. Thereafter, it is only necessary to push bent end sections 18 of wall panels 12 into the gap between spaced apart bent end securing walls 50. This can be performed with bent end section 18 of one wall panel 12, followed by a bent end section 18 of an adjacent wall panel 12, or with the two bent ends sections 18 of adjacent wall panels 12 simultaneously. In such case, lower beveled surface of each bent end securing wall 50 first hits against inclined surface 56 and biases the respective bent end securing wall 50 outwardly away from the other bent end securing wall 50, whereby the distal end of each bent end section 18 can pass into the space between central planar wall 44 and inwardly directed projection 52. Once holding surface 36 passes holding surface 58, the respective bent end securing wall 50 springs back to its original position, whereby nose-shaped inwardly directed projection 52 engages in nose-shaped cut-out section 32. In such case, holding surface 58 engages holding surface 36 to prevent escape of bent end section 18. In such position, outwardly extending stub walls 64 are in abutting or near abutting relation with the respective planar main panel sections 16.

An aspect of the present invention is that the outer surfaces 30 of adjacent bent end sections 18 are in abutting or near abutting relation, that is, they are at least in near abutting relation. As shown in FIG. 3, there is only a very small gap between adjacent outer surfaces so that they are in near abutting relation, but in fact, they can be, and preferably are, in abutting or touching relation with each other. In other words, the gap 74 between the adjacent outer surfaces 30 is so small that it does not permit bent end sections to be pulled out. With this arrangement, there is no need to provide any sealants or plugs in gap 74, and in fact, no such sealants or plugs would even fit within gap 74.

In other words, the two bent end securing walls 50 have a spacing therebetween corresponding substantially to the wall thickness of the two bent end sections 18 held therein.

In this regard, it is very easy to assemble wall panels 12 by merely pressing bent end sections 18 into the space between adjacent bent end securing walls 50.

As shown in FIG. 4, at a corner of existing wall structure 14, corner fastening extrusions 76 are provided, which merely constitute one-half of a main fastening extrusion 38. Thus, each corner fastening extrusion 76 includes one-half of base section 40, and one wing wall 66 having openings 68, and with only one bent end securing wall 50 having an inwardly directed nose-shaped projection 52 formed by inclined surface 56 at the inner surface 54 thereof and terminating in holding surface 58, along with outwardly extending stub wall 64 at the free end thereof.

During assembly at each corner, a first corner fastening extrusion 76 is secured to one wall 14*a* of existing wall structure 14 by screws 70 extending through openings 68 of the wing 66, such that the free end of base section 40 is in abutting relation to the other wall 14*b* of the corner which is perpendicular to wall 14*a*. In this arrangement, there is a space between the bent end securing wall 50 thereof and the parallel other wall 14*b*. A bent end section 18 is then press fit into this space, whereby the bent end securing wall 50 is biased away from the other wall 14*b*, until holding surface 36 passes by holding surface 58, whereupon bent end securing wall 50 springs back to its original position, whereby nose-shaped inwardly directed projection 52 engages in nose-shaped cut-out section 32. In such case, holding surface 58 engages holding surface 36 to prevent escape of bent end section 18. In such position, outwardly extending stub walls 64 are in abutting or near abutting relation with the respective planar main panel section 16.

In this position, the outer surface 30 of the bent end section 18 is in abutting or near abutting relation with the adjacent corner wall 14*b*, that is, it is at least in near abutting relation.

Then, a second corner fastening extrusion 76 is secured to the other wall 14*b* of existing wall structure 14 by screws 70 extending through openings 68 of the wing 66, such that the free end of base section 40 is in abutting relation to planar main panel section 16 of the already assembled wall panel 12. In this arrangement, there is a space between the bent end securing wall 50 thereof and planar main panel section 16 of the already assembled wall panel 12. A bent end section 18 of another wall panel 12 is then press fit into this space, whereby the bent end securing wall 50 is biased away from planar main panel section 16 of the already assembled wall panel 12, until holding surface 36 passes by holding surface 58, whereupon bent end securing wall 50 springs back to its original position, whereby nose-shaped inwardly directed projection 52 engages in nose-shaped cut-out section 32. In such case, holding surface 58 engages holding surface 36 to prevent escape of bent end section 18. In such position, outwardly extending stub walls 64 are in abutting or near abutting relation with the respective planar main panel section 16.

In this position, the outer surface 30 of the bent end section 18 is in abutting or near abutting relation with the adjacent planar main panel section 16, that is, it is at least in near abutting relation.

It will be appreciated that the present invention can be varied within the scope of the claims. In all of the following embodiments, the bend end securing walls 50 are biased outwardly when the bend end sections 18 are pressed into engagement therewith, whereby the bent end sections 18 snap back and are then locked with the bent end securing walls 50.

Figure 6:
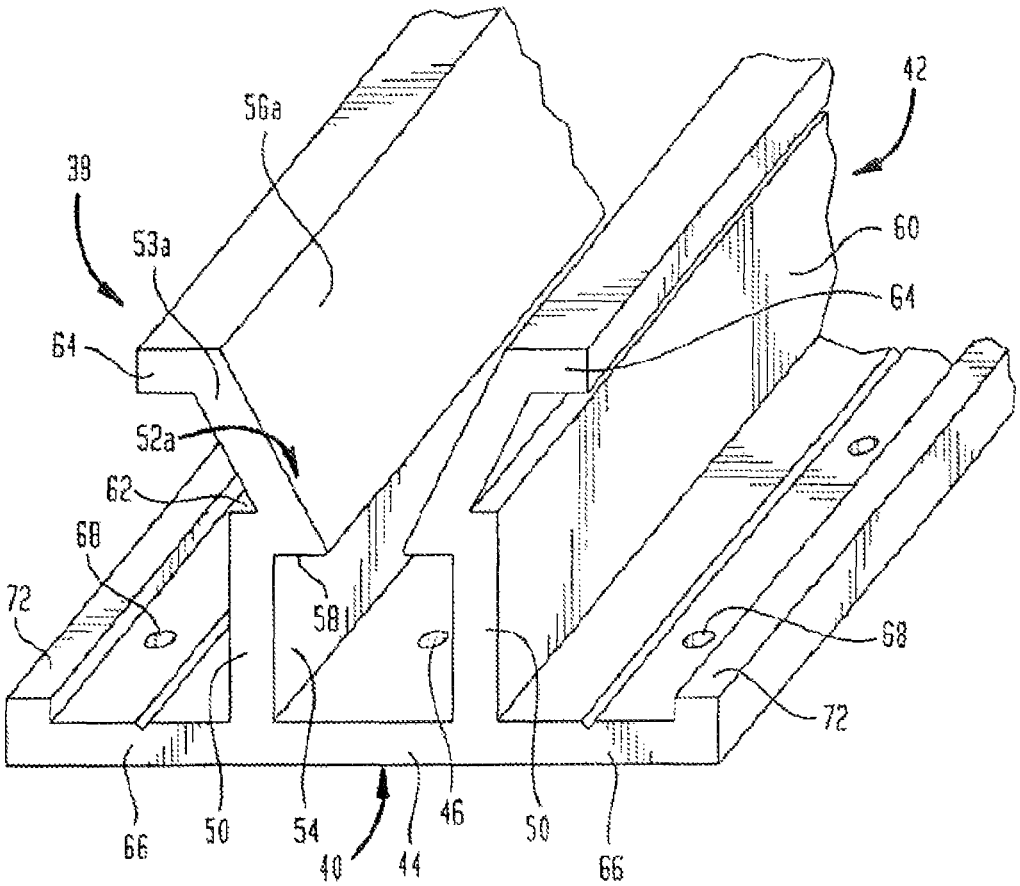
FIG. 6 is a perspective view of a frame extrusion according to another embodiment of the present invention.

Thus, FIG. 6 shows a modification of the embodiment of FIG. 2 in which the inclined surface 56*a* of each inwardly directed projection 52*a* continues upwardly at an angle with an inclined wall 53*a* ends in outwardly extending stub wall 64 that is perpendicular to the respective bent end securing wall and parallel to central planar wall 44, rather than changing direction and running parallel to each bent end securing wall 50. Preferably, although not required, outwardly extending stub wall 64 is in contact with the underside of planar main panel section 16 when inwardly directed projection 52*a* is positioned in cut-out section 32 so as to provide a snap-tight like action with a tight fit so that there is little or no play, whereby wall panels 12 are tightly held in position. This is due to the combination of cut-out section 32 having a holding surface 36 that is substantially parallel to planar main panel section 16 when wall panels 12 are assembled, and the engagement of the stub walls 64 with the underside of planar main panel section 16, which is different from known arrangements which provide arcuate cut-out sections 32.

Of course, it will be appreciated that outwardly extending stub walls 64 can be eliminated, and the free end of inclined wall 53*a* could be used to contact the underside of planar main panel section 16. In either case, stub wall 64 or the free end of inclined wall 53*a* where stub wall 64 is eliminated, it is the free end of bent end section 18 that contacts the underside of planar main panel section 16 to provide the aforementioned tight fit without any play.

Figure 7:
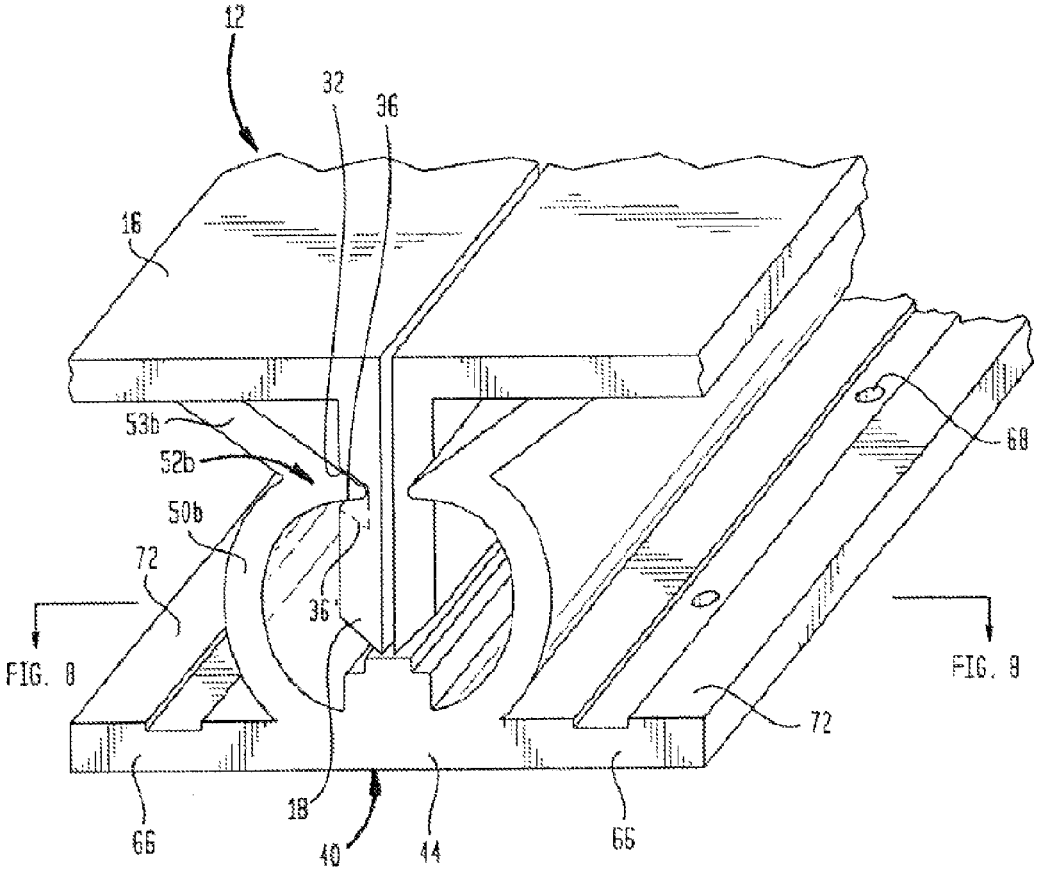
FIG. 7 is a perspective view showing two wall panels connected together by a frame extrusion according to another embodiment of the present invention.
Figure 8:
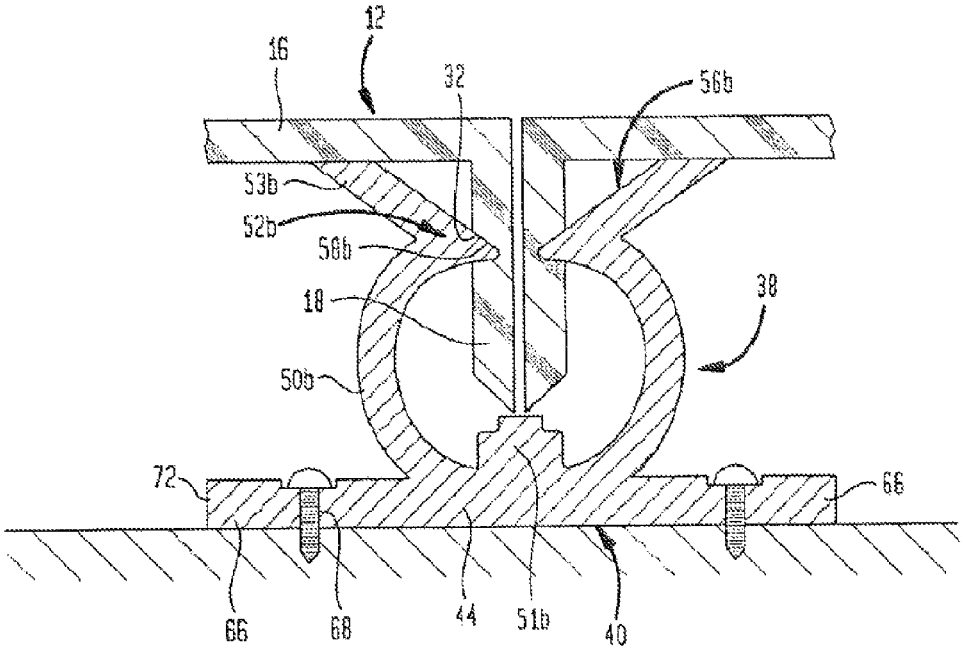
FIG. 8 is a cross-sectional view showing two wall panels connected together by the frame extrusion of FIG. 7.

FIGS. 7 and 8 shows a modification of the FIG. 6 embodiment in which outwardly extending stub walls 64 are eliminated and in which each bent end securing wall 50*b* has an outward curvature, terminating in an inwardly directed projection 52*b*. Further, the inclined surface 56*b* of each inwardly directed projection 52*b* continues upwardly at an angle with an inclined wall 53*b* that abuts against the inner surface or undersurface of planar main panel section 16 since the outwardly extending stub wall is eliminated. As will be understood from the discussion hereafter, bent end securing walls 50*b* are also flexible and resilient, so that they can be bent away from each other and when the bending force is removed, return to their original positions so that inwardly directed projections 52*b* engage in cut-out sections 32 in FIG. 7. In addition, a center platform section 51*b* is provided along the center of base section 40, on which the lower ends of two bent end sections 18 rest. Screws (not shown) can be inserted through center platform section 51*b* to secure the extrusion to the wall.

As will be appreciated from the latter embodiment, the two inwardly directed projections 52*b* have a spacing therebetween which is less than the wall thickness of two said bent end sections 18.

As with the embodiment of FIG. 6, a tight fit is obtained with little play. In both embodiments of FIG. 6 and FIGS. 7 and 8, and contrary to known arrangements, holding surface 36 would be substantially parallel to planar main panel section 16 when wall panels 12 are assembled. However, it is possible that the holding surface is angled in a direction away from the respective main panel section, 16 starting from inner surface 26 of bent end section 18, as shown by dashed line holding surface 36' in FIG. 7. Of course, in the latter situation, holding surface 58*b* of inwardly directed projection 52 would have a similar slope.

Figure 9:
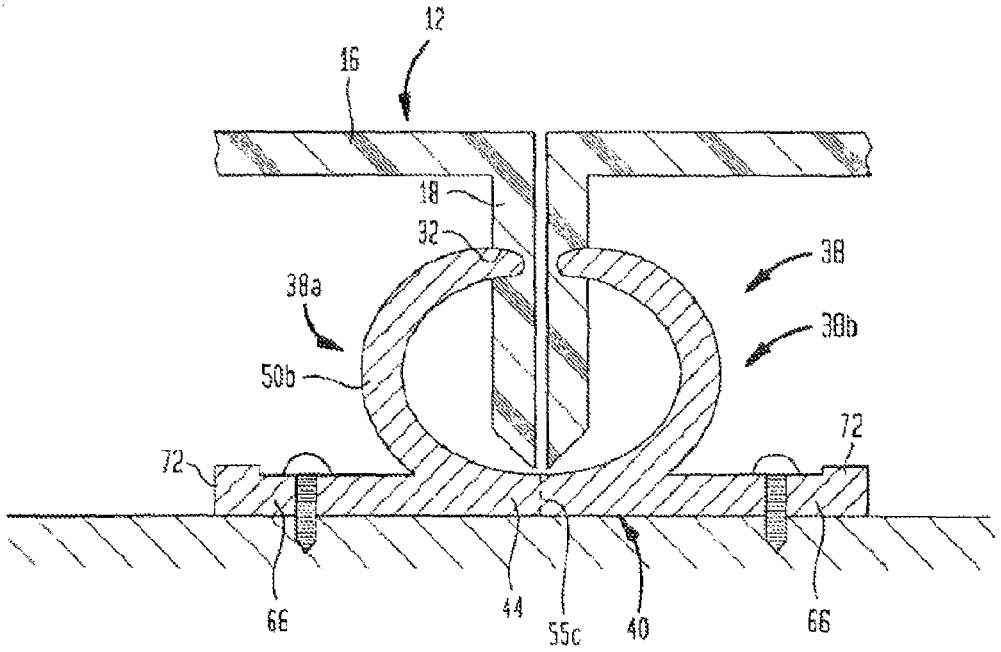
FIG. 9 is a cross-sectional view showing two wall panels connected together by a frame extrusion according to another embodiment of the present invention.

FIG. 9 shows a modification of the FIG. 7 embodiment in which platform 51*b* and inclined walls 53*b* are eliminated. In addition, as with all of the embodiments in the present application, main fastening extrusions 38 can each be formed as a unitary, one piece structure or of two separate main fastening extrusion sections 38*a* and 38*b* divided, as shown, by dashed line 55*c* in FIG. 9.

Figure 10:
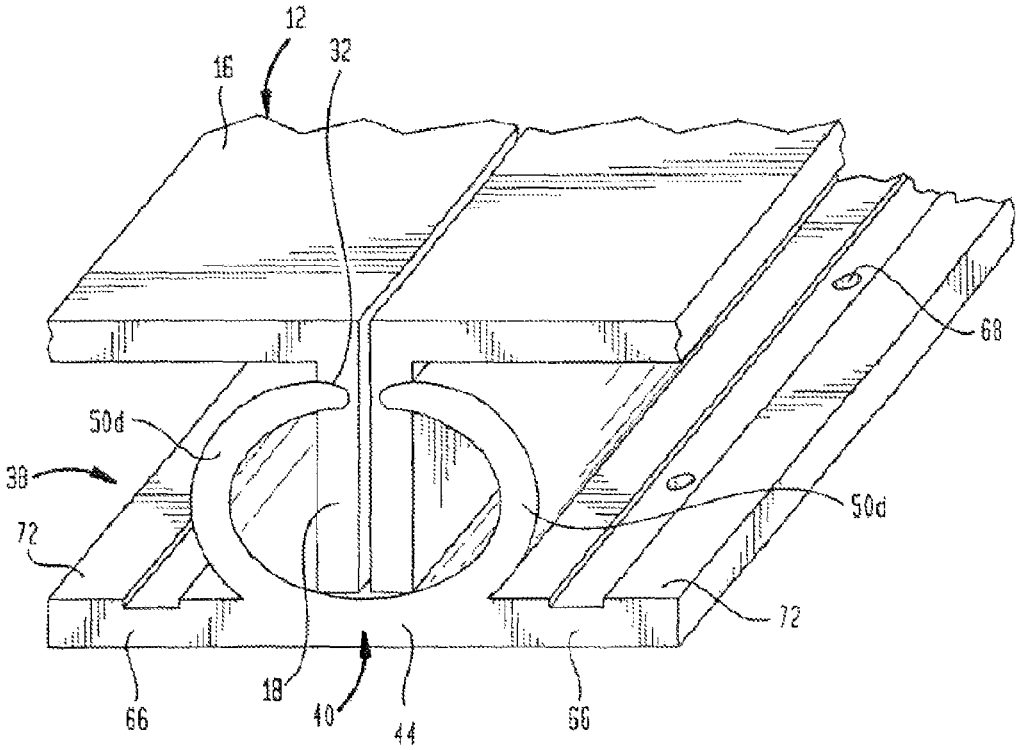
FIG. 10 is a perspective view showing two wall panels connected together by a frame extrusion according to another embodiment of the present invention.

FIG. 10 shows a modification of the FIG. 9 embodiment in which the only change has been changing the arc of outwardly curved bent end securing walls 50*d* so that the free ends thereof engage in cut-out sections 32 at positions close to the inner surfaces of bent end sections 18.

Figure 11:
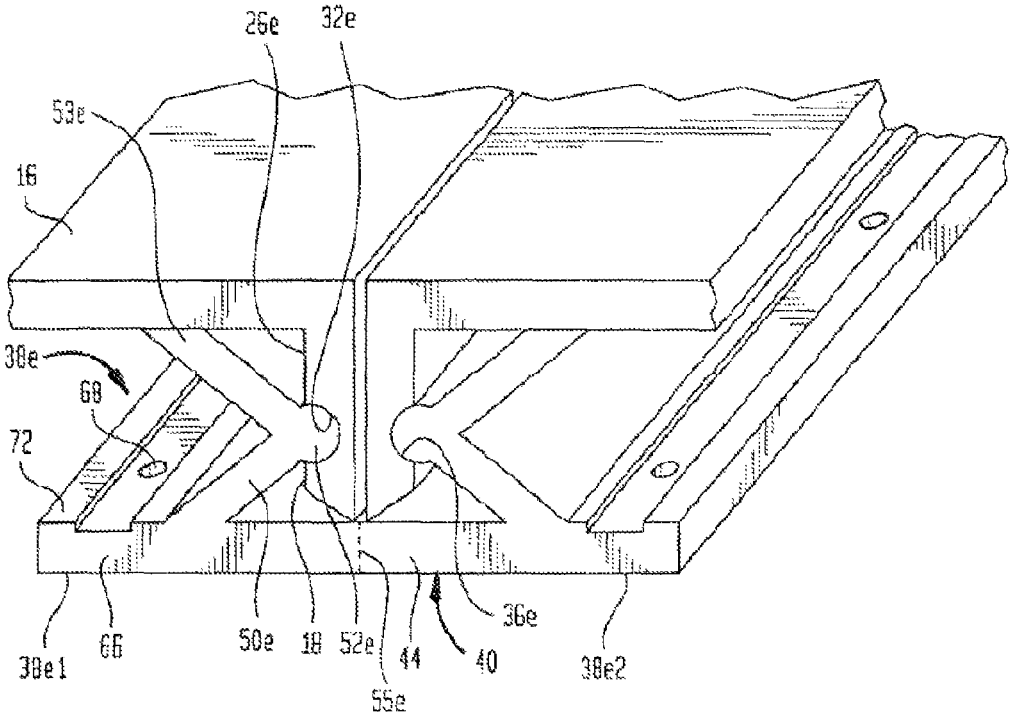
FIG. 11 is a perspective view showing two wall panels connected together by a frame extrusion according to another embodiment of the present invention.

FIG. 11 shows a modification of the FIGS. 7 and 8 embodiment in which the bent end securing walls 50*e* are inclined inwardly in an opposite direction from outwardly inclined walls 53*e* and meet at a cylindrical inwardly directed projection 52*e* which is engaged in a part cylindrical cut-out section 32*e* which has a circumference that extends over an angle greater than 180 degrees. Cylindrical inwardly directed projection 52*e* also has a circumference that extends over an angle greater than 180 degrees and has a diameter similar to the diameter of cylindrical cut-out section 32*e* so that it is force fit and snaps into part cylindrical cut-out section 32*e* in order to lock wall panels 12 and extrusions 38 together. It will be appreciated that, contrary to known arrangements, part cylindrical cut-out section 32*e* and cylindrical inwardly directed projection 52*e* extend over an angle greater than 180 degrees in order to provide this snap fitting arrangement. Of course, because of the snap fitting engagement, inclined wall 53*e* can be eliminated, although it is preferable to include inclined wall 53*a* for purposes of stability of the structural arrangement.

With this embodiment, pressing of bent end sections 18*e* into the spacing between bent end securing walls 50*e* causes bent end securing walls 50*e* to be biased away from each other until projections 52*e* snap engage into respective cut-out sections 32*e* to lock bent end sections 18*e* in the spacing in a manner that outer walls of bent end sections 18*e* are at least in near abutting relation with each other. It will be appreciated, however, that the spacing between bent end sections 18*e* can be much greater such that bent end securing walls 50*e* need not be biased. This is because of the snap fitting relation of projections 52*e* into part cylindrical cut-out sections 32*e*. In the latter case, bent end securing walls 50*e* need not be biased outwardly.

Further, it will be appreciated that, because part cylindrical cut-out section 32*e* extends over an angle greater than 180 degrees, part cylindrical cut-out section 32*e* defines a holding surface 36*e* which is slightly inclined at an angle away from said main panel section 16, starting from the inner wall surface 26*e* of the bent end section 18*e*. Therefore, a positive engagement is provided with little or no room for play or movement of wall panels 12.

Figure 12:
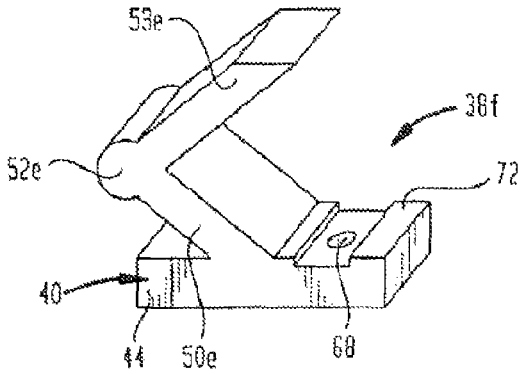
FIG. 12 is a perspective view of a frame extrusion according to another embodiment of the present invention.

As discussed above with respect to FIG. 9, main fastening extrusions 38*e* of FIG. 11 can each be formed as a unitary, one piece structure or of two separate main fastening extrusion sections 38*e*1 and 38*e*2 divided, as shown, by dashed line 55*c* in FIG. 9. In addition, each separate main fastening extrusion section 38*e*1 and 38*e*2 can be formed from a plurality of discrete main fastening extrusions 38*f*, as shown in FIG. 12, which are secured to the wall in parallel, spaced apart relation to each other. This applies to all of the embodiments of the present application.

Figure 13:
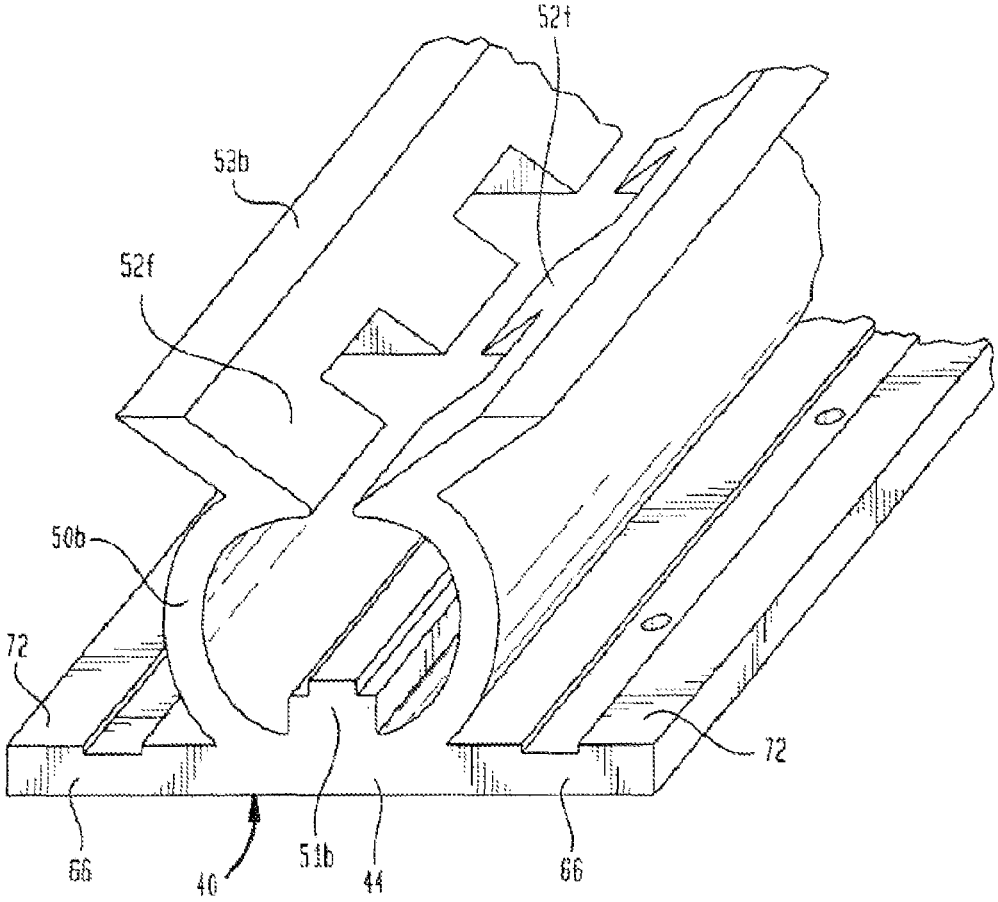
FIG. 13 is a perspective view of a frame extrusion according to another embodiment of the present invention.

It will be appreciated that, with the above embodiments, the respective cut-out section 32 has been continuous. However, it is possible that a plurality of spaced apart cut-out sections 32 can be provided along the length of bent end sections 18, and in such case, each inwardly directed projection 52 would be formed of a plurality of spaced apart inwardly directed teeth 52*f*, as shown in FIG. 13, which is a variation of the embodiment of FIGS. 7 and 8. This applies to all of the embodiments in the present application.

As discussed above, U.S. Pat. No. 4,344,267 to Sukolics, U.S. Pat. No. 4,829,740 to Hutchison and U.S. Pat. No. 5,809,729 to Mitchell, provide a wall system with L-shaped ends of the panels that include recesses in the bent ends that engage with projections of the extrusions secured by screws to the walls, in which there is a large gap between adjacent bent ends. The present invention provides further advances over these systems.

Figure 14:
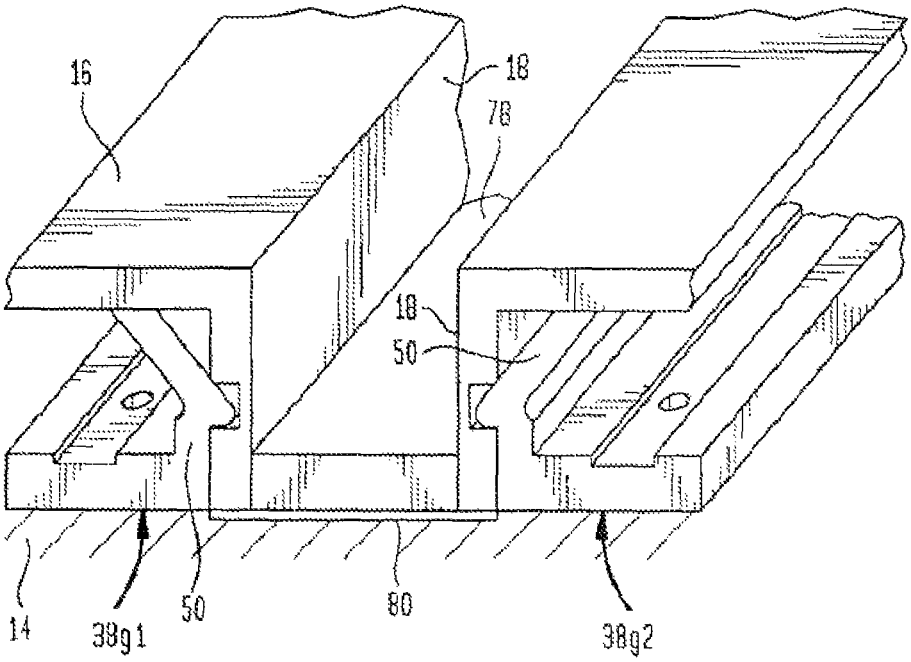
FIG. 14 is a perspective view showing two wall panels connected together by a frame extrusion according to another embodiment of the present invention.
Figure 15:
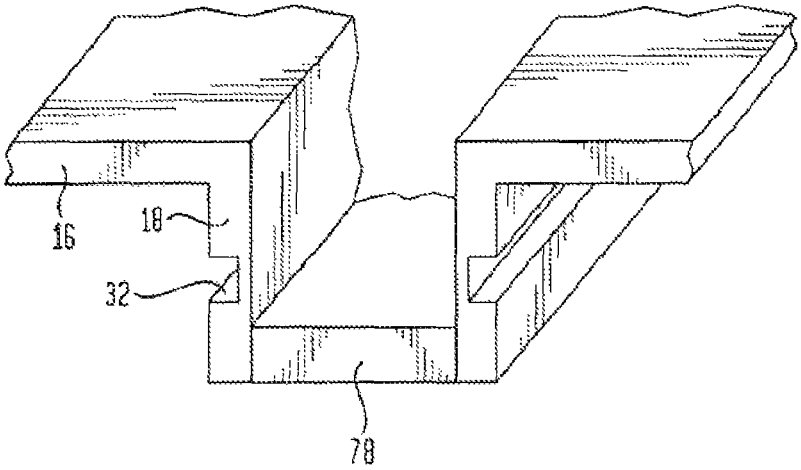
FIG. 15 is a perspective view of the wall panels and spacer member of FIG. 14.
Figure 16:
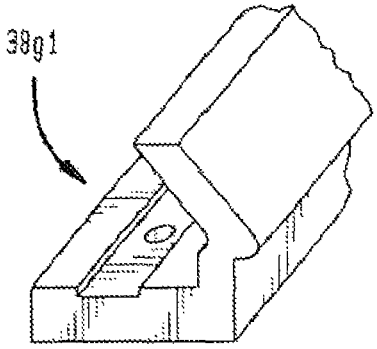
FIG. 16 is a perspective view of the frame extrusion of FIG. 16.

Specifically, as shown in FIGS. 14-16, two separate main fastening extrusion sections 38*g*1 and 38*g*2 are provided, which are of a similar configuration to the main fastening extrusion of FIG. 6, divided along a center line. In the embodiment of FIG. 14, a further spacer member 78 in the shape of a rectangular parallelepiped is first secured to the wall 14 by a double sided adhesive strip 80. Then, separate main fastening extrusion sections 38*g*1 and 38*g*2 are secured to wall by screws, such that the inner surfaces of bent end securing walls 50 thereof are spaced away from the side edges of spacer member 78 by a distance equal substantially to the thickness of a bent end section 18.

Figure 17:
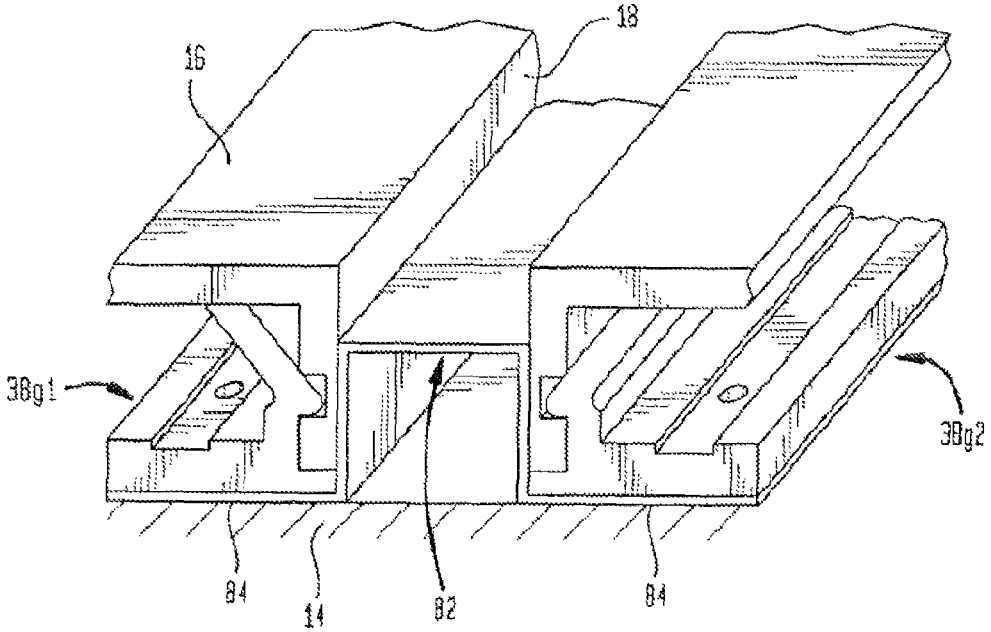
FIG. 17 is a perspective view showing two wall panels connected together by a frame extrusion according to another embodiment of the present invention.

Alternatively, as shown in FIG. 17, a thin walled, inverted U-shaped spacer member 82 is provided in place of spacer member 78 for the same purpose, with U-shaped spacer member 82 including outwardly extending wing sections 84 that extend between separate main fastening extrusion sections 38*g*1 and 38*g*2 and wall 14.

Figure 18:
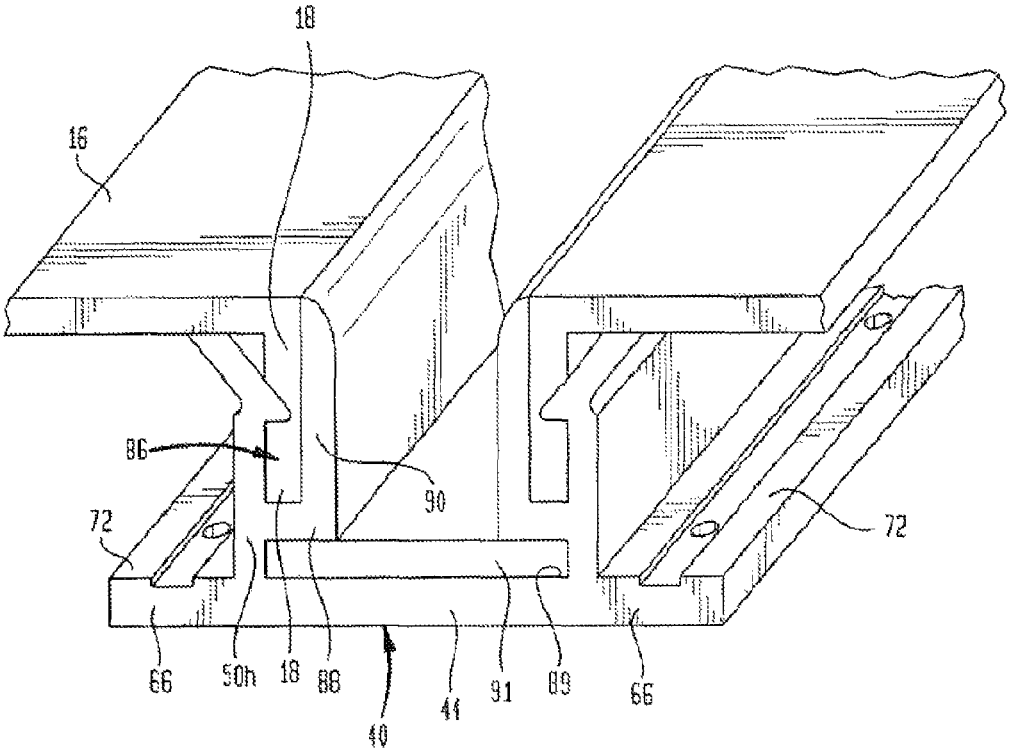
FIG. 18 is a perspective view showing two wall panels connected together by a frame extrusion according to another embodiment of the present invention.

FIG. 18 shows another embodiment which is similar to that of FIG. 6, except that bent end securing walls 50*h* are spaced apart further than that in the embodiment of FIG. 6. With this embodiment, an upwardly extending L-shaped extension 86 extends includes a first leg 88 as a lateral connecting wall that extends inwardly from a lower portion of bent end securing wall 50*h* and a second leg 90 as an inner wall that extends upwardly from the free end of first leg 88 and in parallel spaced apart relation to the respective securing wall 50*h* with a spacing substantially equal to the thickness of a bent end section 18 which fits therein. In this manner, bent end sections 18 are inserted in the gap between a securing wall 50*h* and respective second leg 90. With this arrangement, there is a space 89 between central planar wall 44 and each first leg 88. A closure plate 91 of a rectangular parallelepiped shape is inserted in spaces 89 and also spans the distance between second legs 90 so as to form an aesthetic closure.

Figure 19:
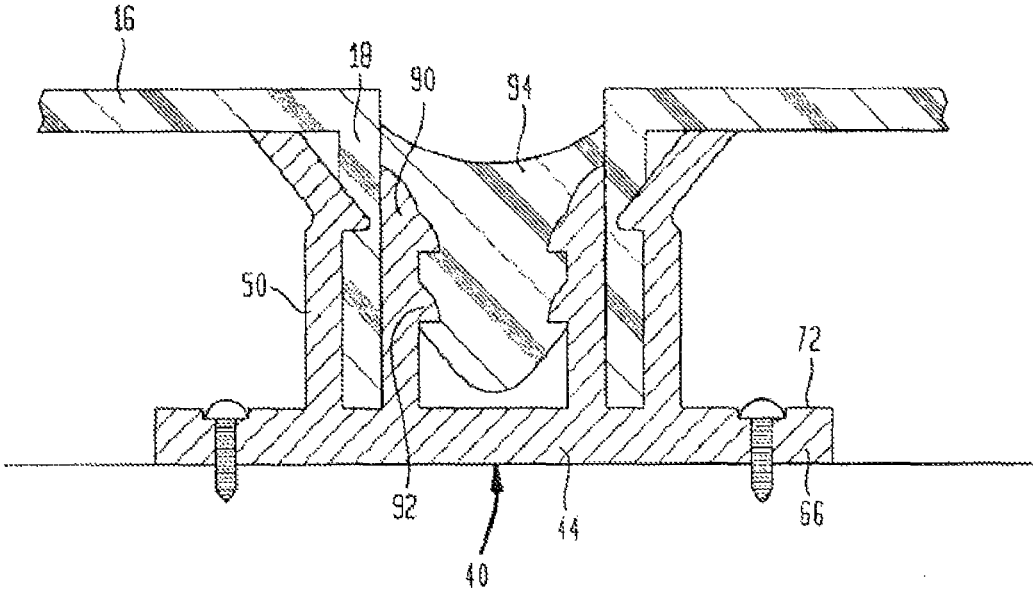
FIG. 19 is a cross-sectional view showing two wall panels connected together by a frame extrusion according to another embodiment of the present invention.

FIG. 19 shows another embodiment similar to that of FIG. 18, in which second legs 90 extend upwardly from central planar wall 44 of base section 40, and first legs 88 are eliminated. The inner facing surfaces of second legs 90 are further provided with barbs 92 that are angled toward base section 44. In this manner, a plug 94 can be inserted within the gap between second legs 90 for closing off the gap and providing an aesthetic appearance, with the plug 94 engaged by barbs 92.

It will be appreciated that the securement of the wall panels in FIGS. 14-19 occurs in the same manner discussed above with respect to the embodiments of FIGS. 6-8.

Figure 20:
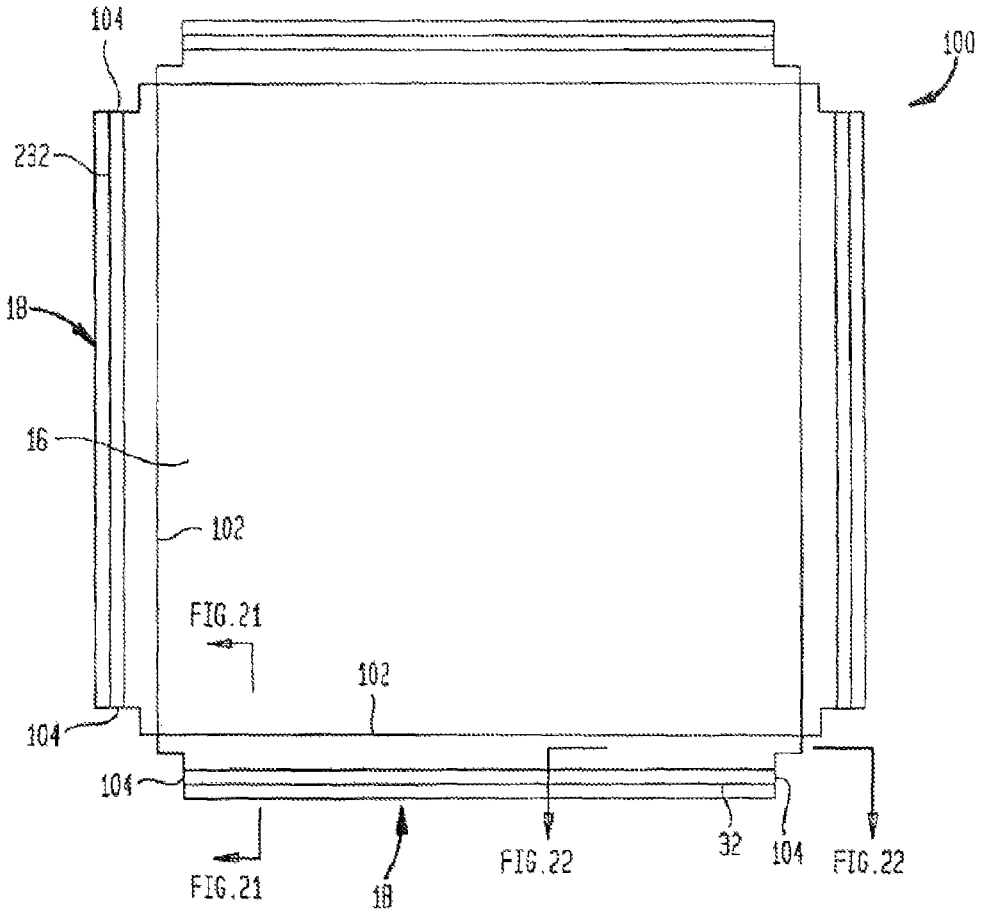
FIG. 20 is a top plan view of a planar blank used for forming a wall panel.
Figure 21:
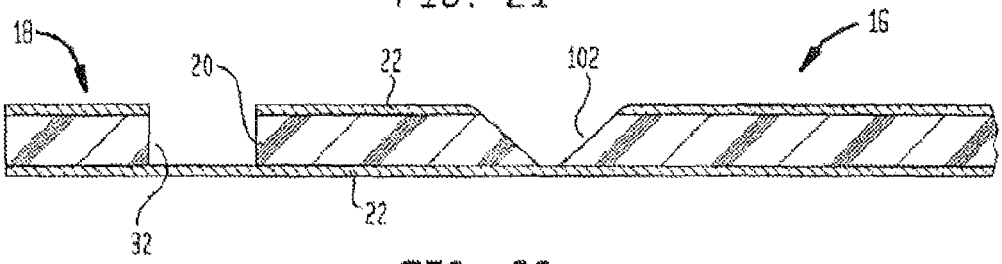
FIG. 21 is a cross-sectional view of the planar blank of FIG. 20, taken along line 21-21 thereof.
Figure 22:
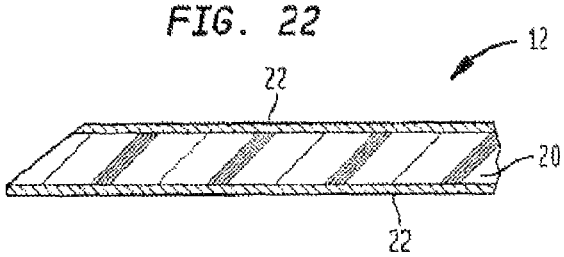
FIG. 22 is a cross-sectional view of the planar blank of FIG. 20, taken along line 22-22 thereof.

With all of the above embodiments, each wall panel is preferably formed from a planar blank 100 shown in FIG. 20, which is formed preferably by, but not limited to, a polyethylene core 20 with a thin aluminum wall 22 covering opposite sides thereof, as shown in FIGS. 5, 21 and 22. Each planar blank 100 can be stamped from or cut from a larger sheet of the respective material.

Specifically, each planar blank 100 is formed by planar main panel section 16 which is preferably, but not limited to, a square shape with all sides being equal. There are four bent end sections 18, each formed as one piece at a respective side edge of planar main panel section 16, and coplanar therewith. A V-shaped cut-out 102 extends through one thin aluminum wall 22 and polyethylene core 20 at the connecting edge of each bend end section 18 to the side edge of planar main panel section 16, as best shown in FIG. 21. This permits each bent end section 18 to be bent along its respective V-shaped cut-out 102 at a right angle to planar main panel section 16 in the manner shown, for example, in FIG. 3. Each bent end section 18 further includes cut-out section 32 at the inner surface 26 thereof and spaced slightly away from main panel section 16. Each cut-out section 32 can take any suitable shape, such as the nose-shaped configuration in cross-section of FIG. 3, the rectangular configuration in cross-section of FIG. 15, the part-cylindrical configuration in cross-section of FIG. 11, etc., or any other suitable configuration.

Figure 23:
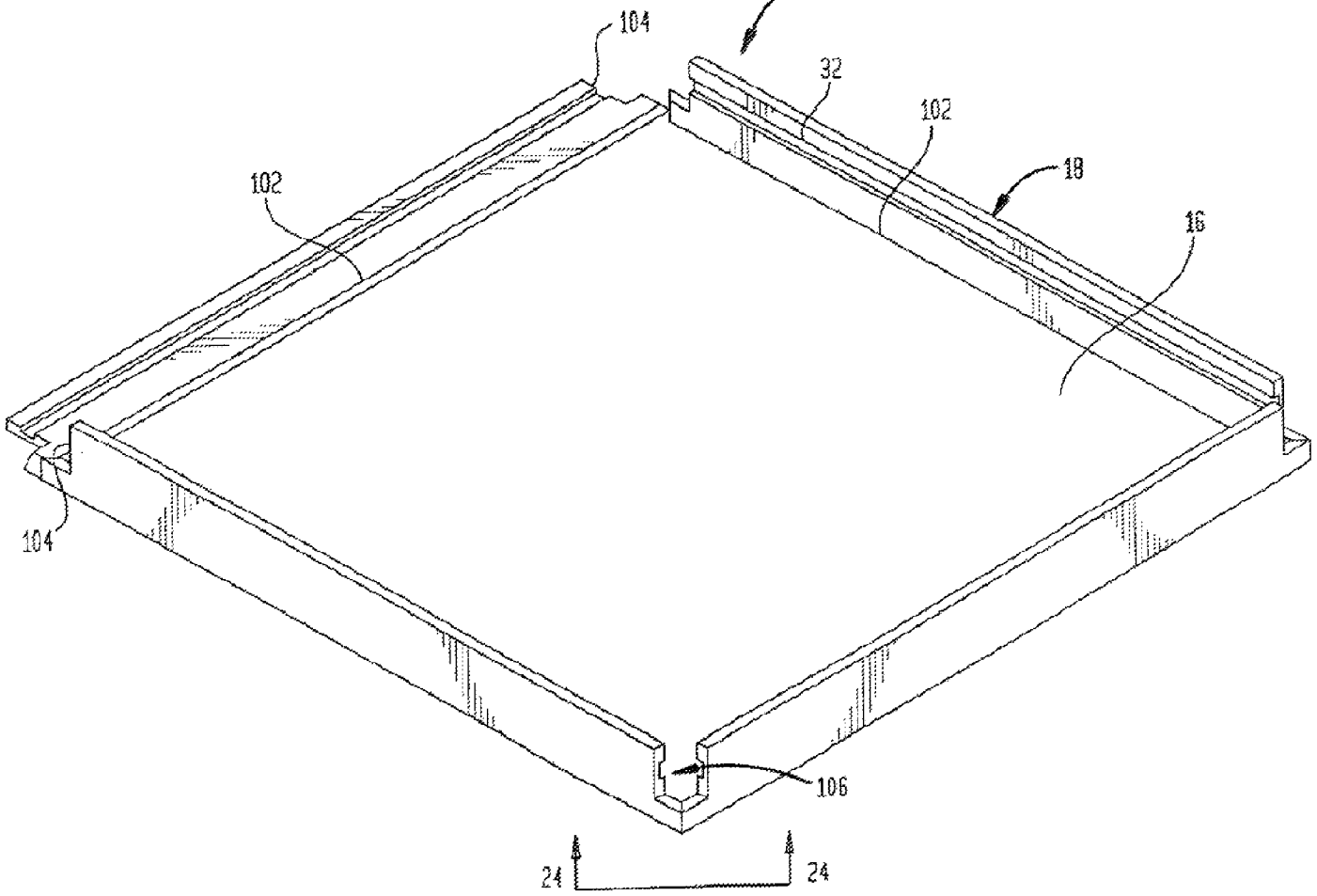
FIG. 23 is a perspective view of the blank of FIG. 20, with three bent end sections bent at right angles with respect to the planar main panel section.
Figure 24:
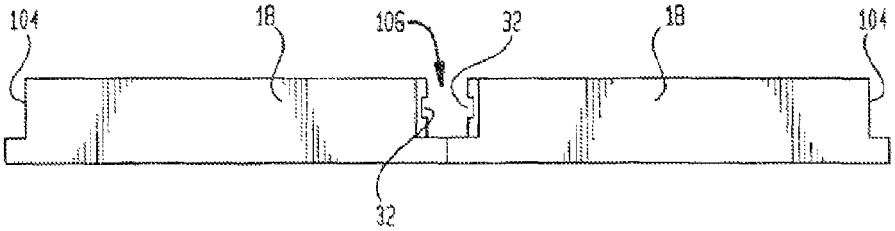
FIG. 24 is an elevational view of the blank of FIG. 23, viewed along line 24-24.
Figure 25:
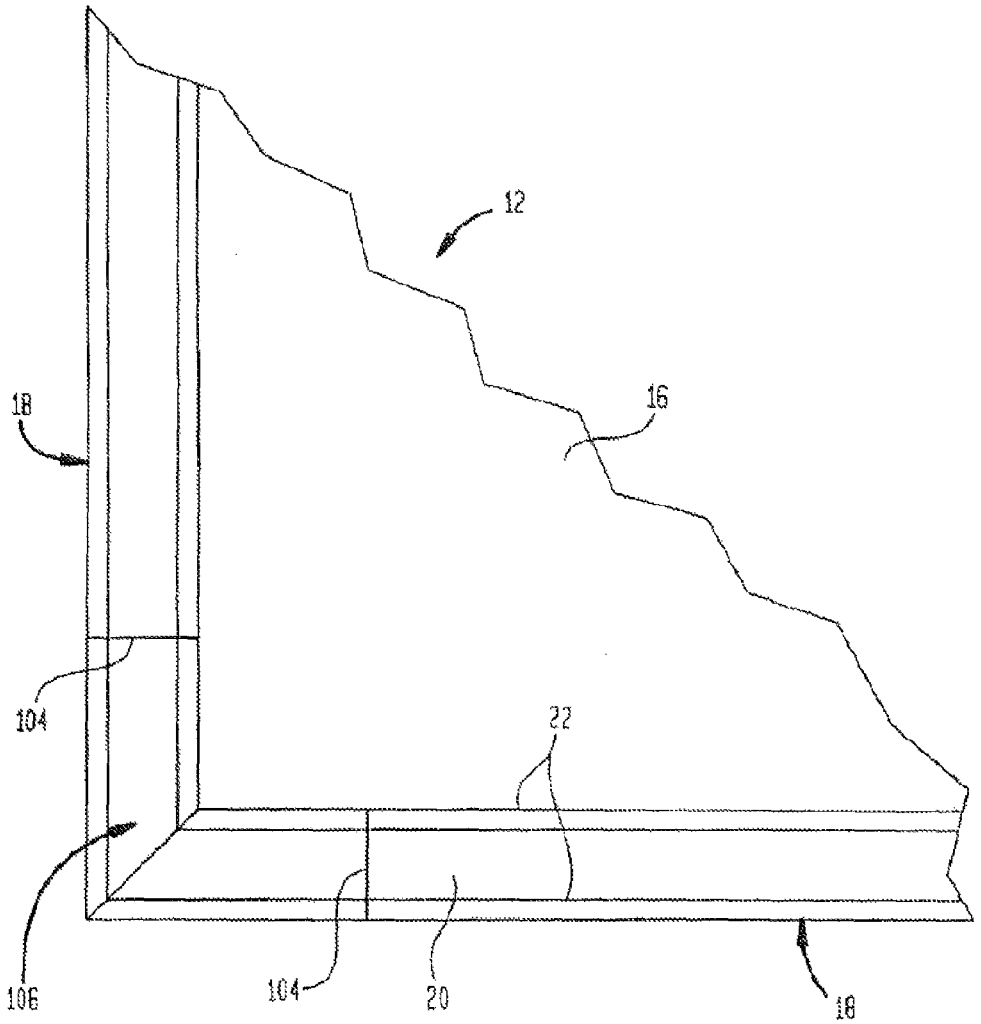
FIG. 25 is a top plan view of one of the corners which is circled in FIG. 23 where two bent end sections are both bent at rights angles with respect to the planar main panel section.
Figure 27:
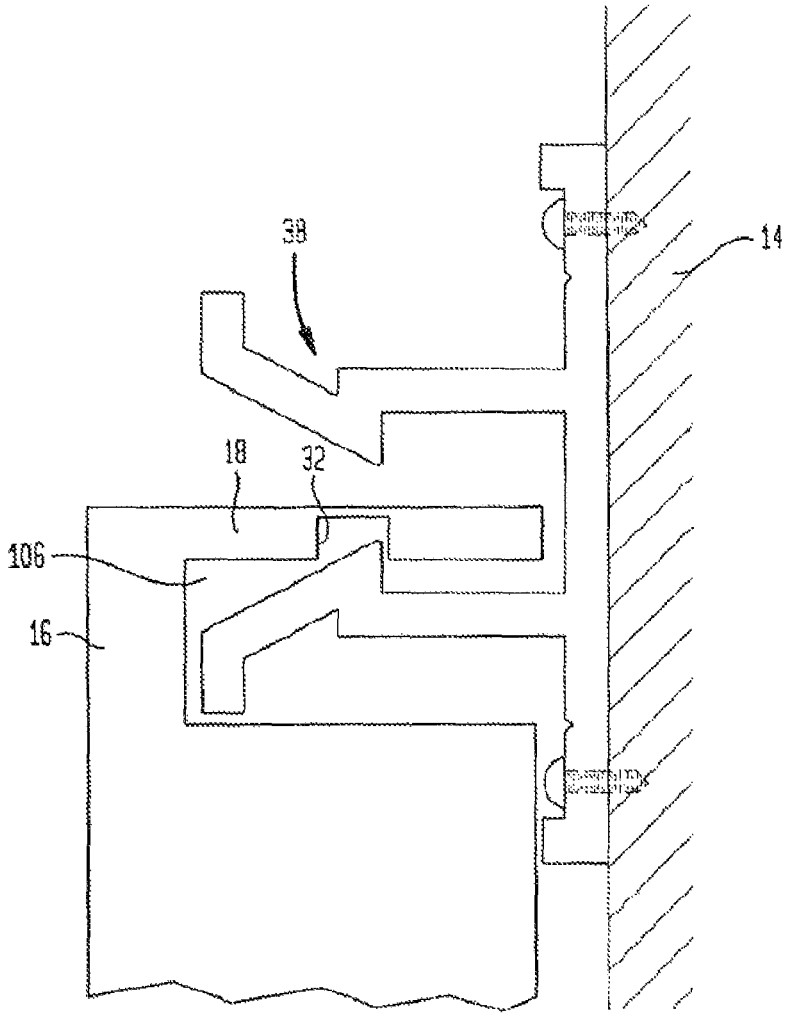
FIG. 27 is an end elevational view of a wall panel hung on a main fastening extrusion for sliding therealong.
Figure 28:
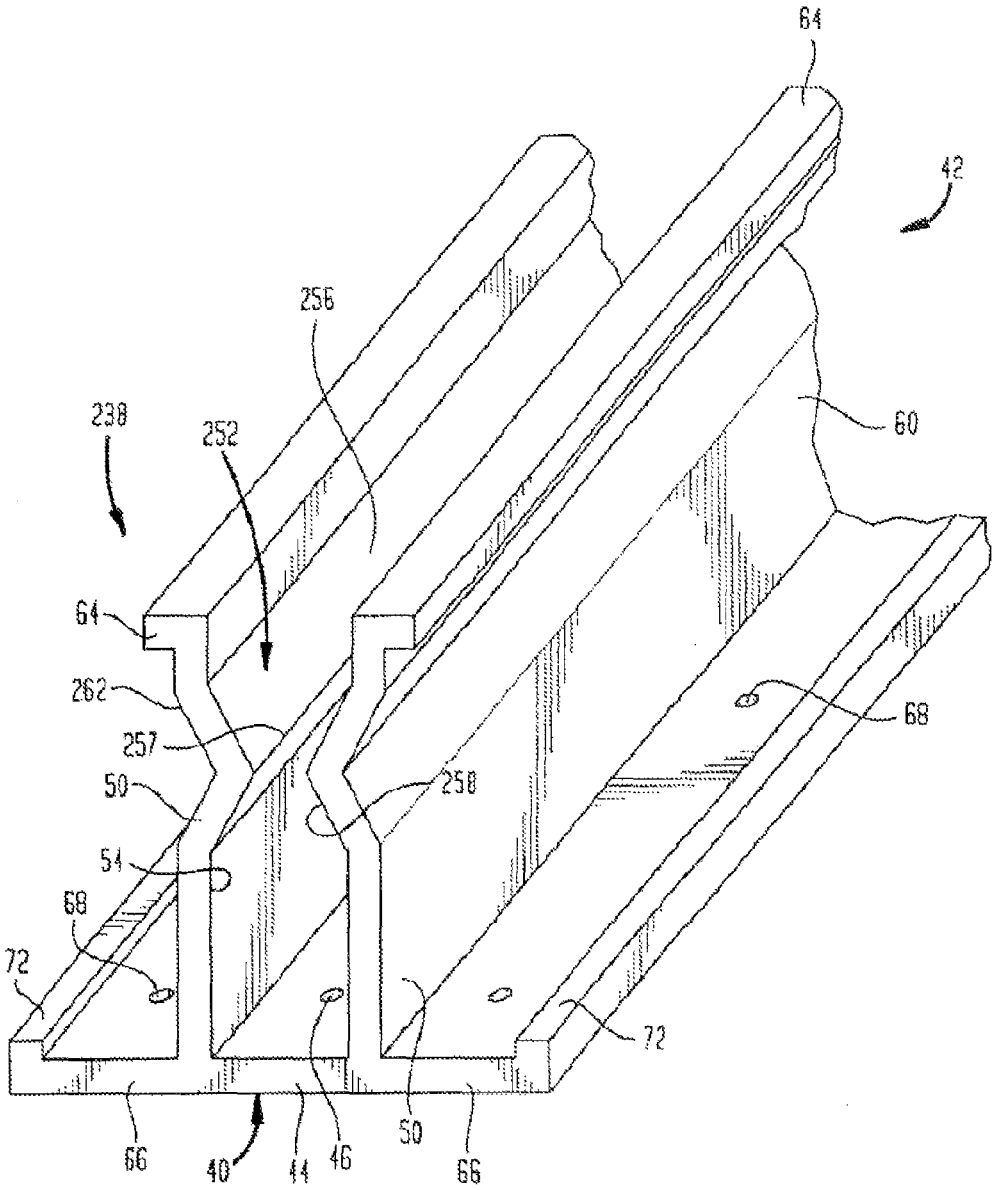
FIG. 28 is a perspective view of a frame extrusion according to another embodiment of the present invention.

In accordance with an aspect of the present invention, the opposite ends of each bent end section 18 have a rectangular cut-away section 104. Three of the bent end sections 18 are bent along V-shaped cut-outs 102 in FIG. 23 for illustration purposes only, and as shown in FIGS. 23-25, at the corners where bent end sections 18 are bent at right angles to planar main panel section 16, corner openings or cut-away sections 106 are provided. As a result, when a main fastening extrusion 38, such as the one shown in FIGS. 6 and 27, is secured to an existing wall structure 14, such that it extends along the entire length of the existing wall structure 14, wall panels 12 can merely be hung thereon in the manner shown in FIG. 27 and slid therealong, as a result of corner openings 106.

Of course, it will be appreciated that each corner opening 106 can be formed by a single cut-away section 104, that is, one bent end section 18 at a corner may not include a cut-away section 104.

Figure 25A:
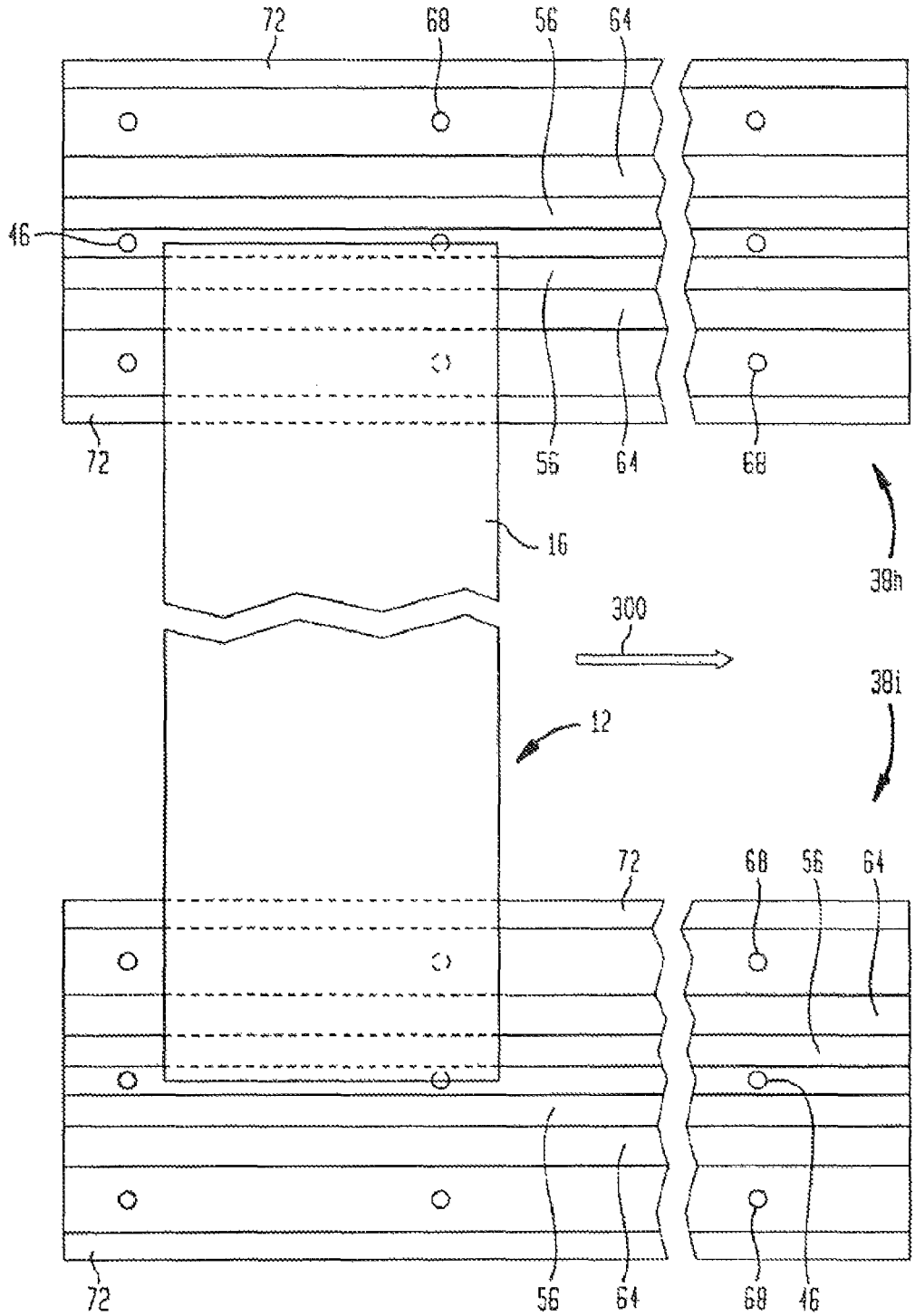
FIG. 25A is an elevational view showing assembly and sliding of a wall panel on two parallel, spaced apart extrusions.

Further, it will be appreciated that the use of corner openings 106 is used with each of the above embodiments. This is a great advantage over known systems in which the panels have to be carefully placed over the extrusions. With this system, the extrusions are mounted to a wall, and the panels are placed on the extrusions and can be slid therealong so as to be easily adjusted in position. Therefore, there is a great savings in time during construction. Specifically, as shown in FIG. 25A, there is shown a front elevational view of a wall having two parallel, spaced apart, elongated fastening extrusions 38*h* and 38*i*, of the type shown in FIG. 2 mounted to a wall 14. A wall panel 12 of much less length is shown mounted thereto. For example, fastening extrusions 38*h* and 38*i* may extend along the entire length of a wall 14, for holding, for example, ten or more wall panels 12 thereon. In such case, only the bent end sections 18 at the upper and lower edges of wall panel 12 are engaged with the two fastening extrusions 38*h* and 38*i*. Specifically, the upper bent end section 18 is preferably engaged with the upper fastening extrusion 38*h* and then that wall panel 12 can be slid along fastening extrusions 38*h* and 38*i* in the direction of arrow 300 to a desired position, either vertically or horizontally, whereupon the lower bent end section 18 is snapped into engagement with the lower fastening extrusion 38*i*. Alternatively, both upper and lower bent end sections 18 can be snapped into engagement with fastening extrusions 38*h* and 38*i*, and the wall panel then slid therealong to the desired position. It will be appreciated that wall panel 12 may also include side bent end sections 18 as well, in order to provide a finished appearance to the exposed surface of the wall panel, and for this reason, the use of corner cut-away section or opening 104 is essential for permitting this sliding arrangement. This provides for easy and accurate leveling along the entire wall during installation.

With all of the above arrangements, the main fastening extrusions are all secured to a wall in a predetermined spaced relationship to each other. Thereafter, it is only necessary to snap in the wall panels, whereby the bent end sections of each pressed or snapped in wall panel function to bend the flexible and resilient bent end securing walls of the respective main fastening extrusion away from the bent end sections until the inwardly directed projections of the bent end securing walls enter the respective cut-out sections of the bent end sections of the wall panels to secure the wall panels in place. Thus, there is no need to hold the walls panels in position on the wall, or with the main fastening extrusions, while subsequently requiring the insertion by screws as in the prior art. Therefore, assembly is very easy with the present invention by a mere press fit.

Figure 26:
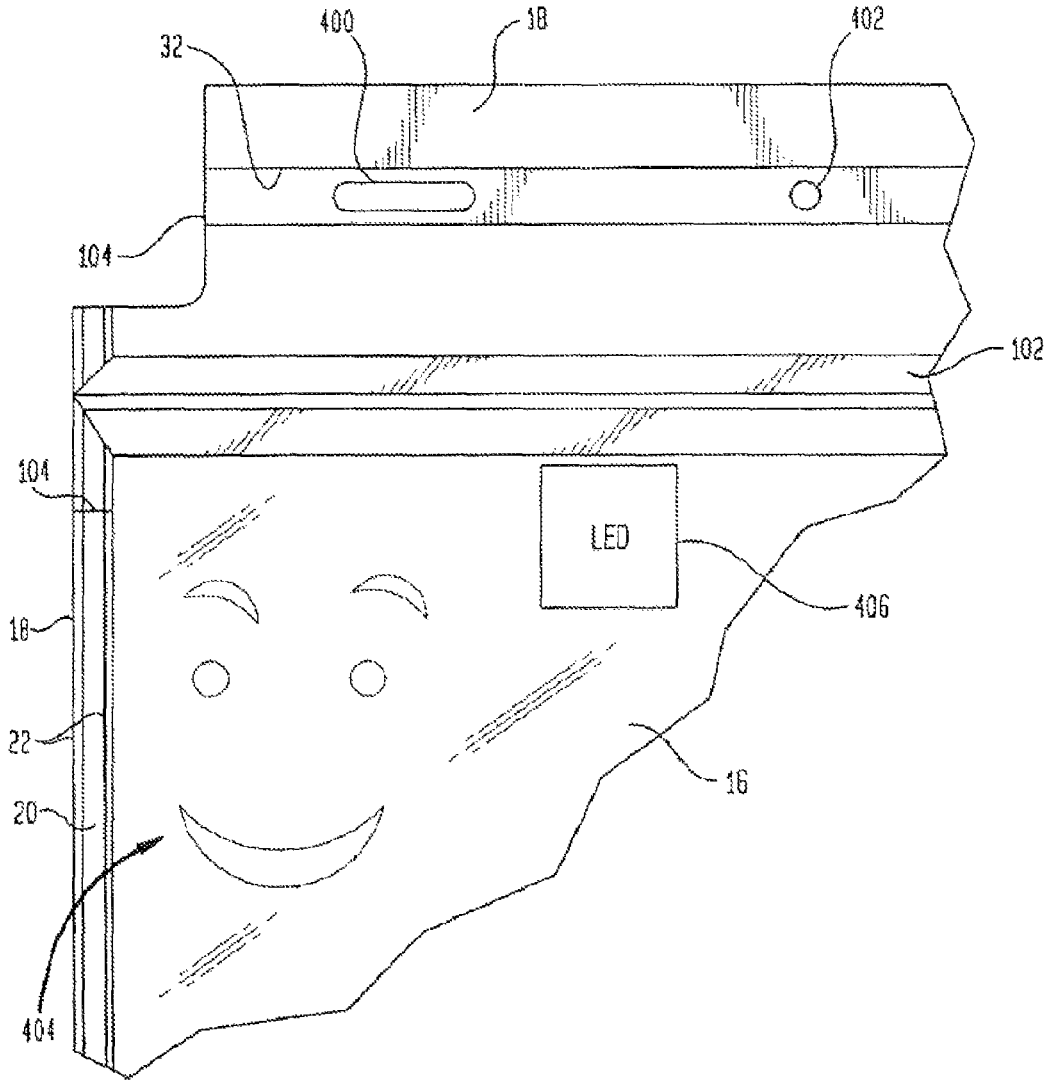
FIG. 26 is a top plan view of one of the corners which is circled in FIG. 23 where only one bent end section is bent at a rights angle with respect to the planar main panel section.

In addition, as shown in FIG. 26, openings in any shape, such as a slot opening 400, a circular opening 402 or the like can be provided in bent end sections 18, for example, in cut-out sections 32 or otherwise, or even in main panel section 216, for example, as shown by the openings which form a face 404, any picture, advertising, a message or the like. Light emitting diodes (LEDs) 406 or any other light source can be provided, for example, on the inner facing surface of main panel section 216, so that light therefrom is emitted out from openings 400, 402 and 404.

With all of the above embodiments, because of the holding surfaces of the cut-out sections and the respective holding surfaces of the projections, the wall panels are positively and securely held in position so that they cannot be removed. This is ideal for wall panels secured to the outside of a building. However, for wall panels secured to an inner wall of a building, where vandalism is not a large issue, it may be desirable to replace the walls panels with new wall panels. In such case, it is desirable that the wall panels be positively and securely held in position, but also that the wall panels be permitted to be readily removed for interchanging with different wall panels.

In this regard, reference is first made to FIGS. 28-31, which correspond to FIGS. 2-5, but which show modified wall panels 212 and a modified main fastening extrusion 238, with all like elements from wall panels 12 and main fastening extrusion 38 identified by the same reference numerals.

Wall panels 212 differ from wall panels 12 in that nose-shaped cut-out section 32 is replaced by a V-shaped cut-out section 232. Specifically, each cut-out section 232 has a first inclined wedge surface 234 that meets a second reverse inclined wedge surface 236 that extends at an opposite inclination to first inclined wedge surface 234 and which meet at a vertex 235. As a result, inclined wedge surfaces 234 and 236 form straight planar, wedge surfaces, as will be understood from the discussion hereafter.

V-shaped cut-out section 232 preferably extends along the entire length of the bent end section 18, although the present invention is not so limited, that is, cut-out section 232 can extend along only a part of the length of bent end section 18, or there may be a plurality of spaced apart cut-out sections 232.

In like manner, main fastening extrusions 238 differ from main fastening extrusions 38 in that nose-shaped projection 52 is replaced by a V-shaped projection 252. Specifically, each V-shaped projection 252 has a first inclined wedge surface 256 that meets a second reverse inclined wedge surface 258 that extends at an opposite inclination to first inclined wedge surface 256 and which meet at a vertex 257. As a result, inclined wedge surfaces 256 and 258 form straight planar, wedge surfaces, as will be understood from the discussion hereafter.

V-shaped projection 252 preferably extends along the entire length of the bent end securing wall 50, although the present invention is not so limited, that is, V-shaped projection 252 can extend along only a part of the length of bent end securing wall 50, or there may be a plurality of spaced apart V-shaped projections 252.

Figure 29:
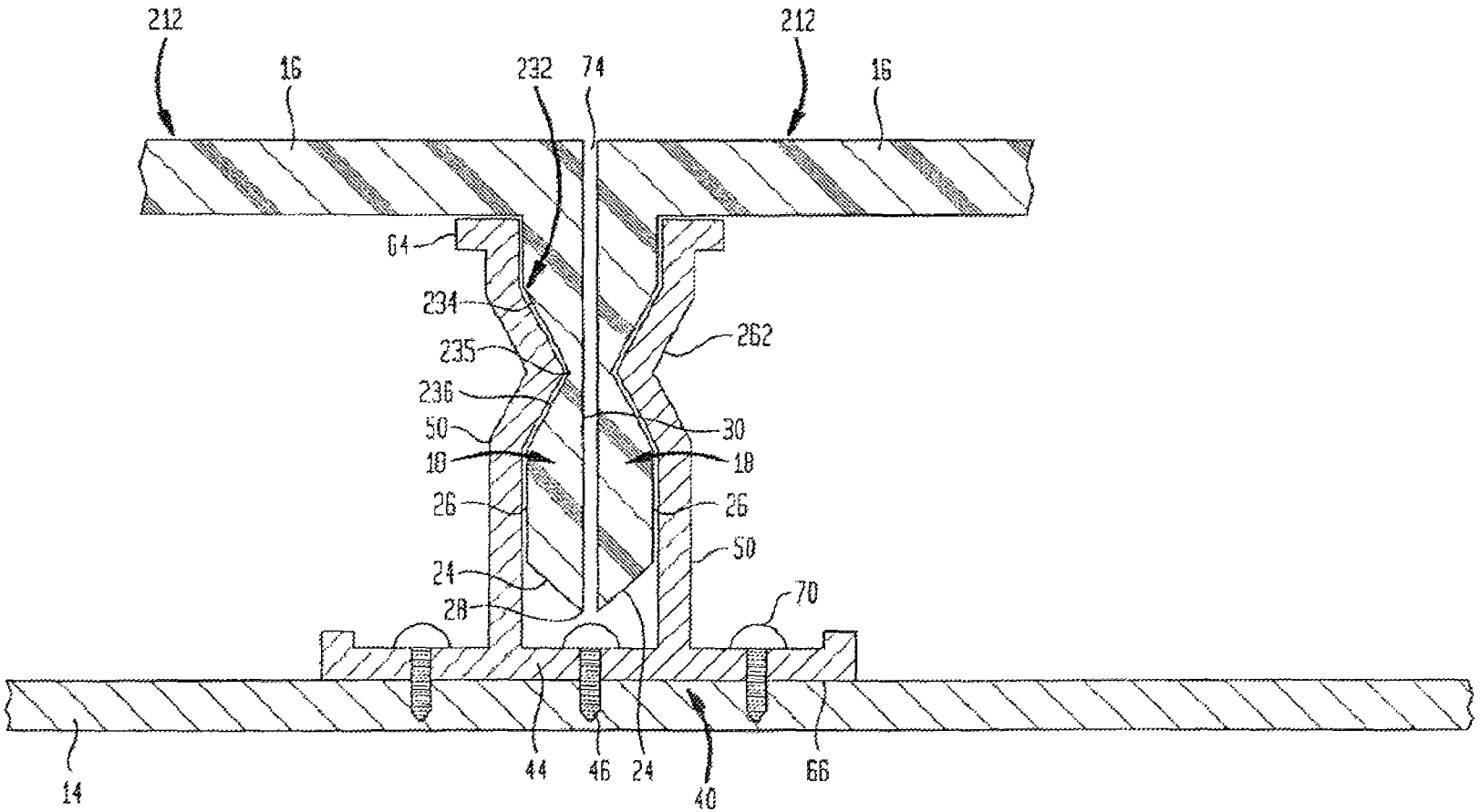
FIG. 29 is a cross-sectional view showing two wall panels connected together by the frame extrusion of FIG. 28.
Figure 30:
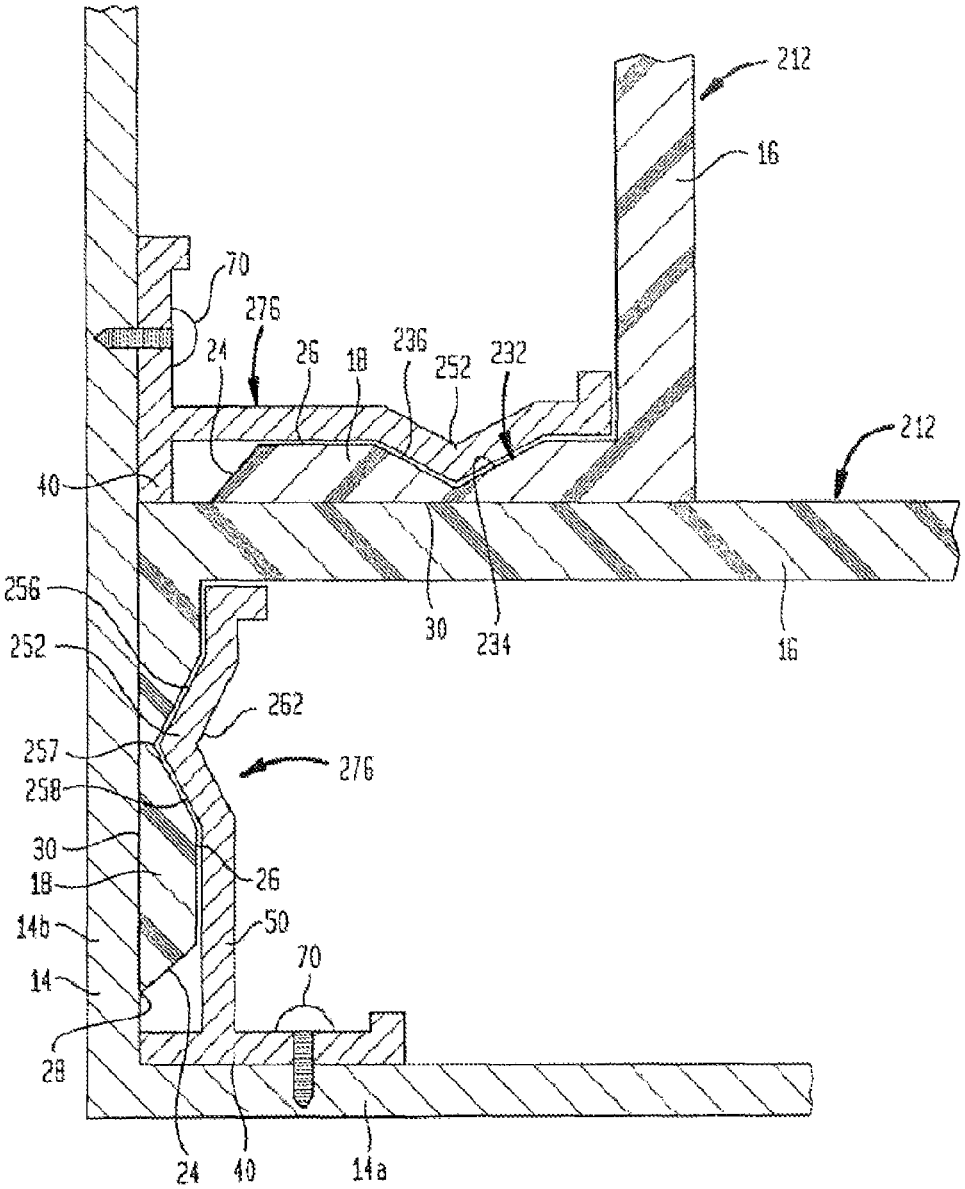
FIG. 30 is a cross-sectional view showing two wall panels connected together by a corner frame extrusion.
Figure 31:
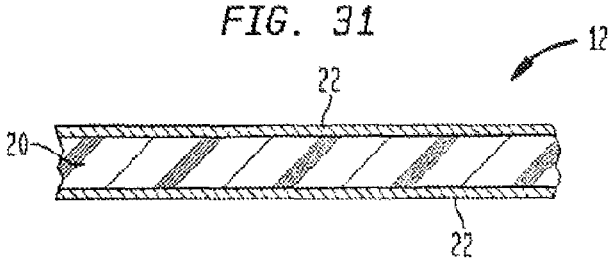
FIG. 31 is a cross-sectional view of a wall panel.

As shown in FIGS. 29 and 30, the outer surface 60 of each bent end securing wall 50 includes a V-shaped cut-out section 262 corresponding in position to V-shaped projection 252, in order to save material, although the present invention is not limited thereby, and V-shaped cut-out section 262 can be eliminated.

With this arrangement, main extrusions 238 are first secured to existing wall structure 14 by screws 46 and 70 at predetermined spacing intervals determined by the dimensions of wall panels 12. Thereafter, it is only necessary to push bent end sections 18 of wall panels 12 into the gap between spaced apart bent end securing walls 50. This can be performed with bent end section 18 of one wall panel 12, followed by a bent end section 18 of an adjacent wall panel 12, or with the two bent ends sections 18 of adjacent wall panels 12 simultaneously. In such case, lower beveled surface of each bent end securing wall 50 first hits against inclined wedge surface 256 and biases the respective bent end securing wall 50 outwardly away from the other bent end securing wall 50, whereby the distal end of each bent end section 18 can pass into the space defined between central planar wall 44 and inwardly directed V-shaped projection 252. Once reverse inclined wedge surface 236 passes inclined wedge surface 256, the respective bent end securing wall 50 springs back to its original position, whereby V-shaped inwardly directed projection 252 releasably engages in V-shaped cut-out section 232. In such case, inclined wedge surface 256 engages or is in near proximity to inclined wedge surface 234 and reverse inclined wedge surface 258 engages or is in near proximity to reverse inclined wedge surface 236 to retain bent end section 18, while still permitting release by a sufficient pulling action at a later time to replace the wall panels. Preferably, in such position, outwardly extending stub walls are in abutting or near abutting relation with the respective planar main panel sections 16.

In the embodiment of FIGS. 2-5, holding surfaces 36 and 58 prevent the escape of the wall panels 12. This makes it very difficult to remove existing mounted wall panels 12 and replace the same with new wall panels 12. However, with the present invention, because of engaging V-shaped cut-out section 232 and V-shaped projection 252, that is, because the holding surfaces 36 and 58 of the embodiment of FIGS. 2-5 are replaced by reverse inclined wedge surfaces 236 and 258, the wall panels 12 are held in a mounted state, but can be removed and replaced by new wall panels 12 by merely pulling out the already mounted wall panels 12. This is because reverse inclined surfaces 236 and 258 permit such action. In such case, a reverse wedging operation occurs, with reverse inclined wedge surfaces 236 and 258, during pull-out, causing bent end securing walls 50 to be biased away from each other by the wedging action, until vertices 235 pass lower beveled surfaces 24, whereby bent end securing walls 50 spring back to their original positions.

It is noted that this embodiment provides two distinctions over the prior art of U.S. Pat. No. 4,344,267 to Sukolics, U.S. Pat. No. 4,829,740 to Hutchison. In the latter patents, there is no indication that the bent end securing walls of these patents can be biased outwardly, and in fact, this would be contrary to the operation thereof, and also, these patents provide a part circular cut-out section and projection which may inhibit a wedging operation.

It is noted that the outer surfaces 30 of adjacent bent end sections 18 are in abutting or near abutting relation, that is, they are at least in near abutting relation. As shown in FIG. 29, there is only a very small gap between adjacent outer surfaces so that they are in near abutting relation, but in fact, they can be, and preferably are, in abutting or touching relation with each other. With this arrangement, there is no need to provide any sealants or plugs in gap 74, and in fact, no such sealants or plugs would even fit within gap 74.

In other words, the two bent end securing walls 50 have a spacing therebetween corresponding substantially to the wall thickness of the two bent end sections 18 held therein.

In this regard, it is very easy to assemble wall panels 12 by merely pressing bent end sections 18 into the space between adjacent bent end securing walls 50, and in like manner, wall panels 12 can be readily removed by merely pulling them out with sufficient force.

FIG. 30 shows the same structure as FIG. 4, at a corner of an existing wall structure 14, but in which corner fastening extrusions 276 differ from corner fastening extrusions 76 in that nose-shaped projection 52 is replaced by a V-shaped projection 252. Specifically, each V-shaped projection 252 has a first inclined wedge surface 256 that meets a second reverse inclined wedge surface 258 that extends at an opposite inclination to first inclined wedge surface 256 and which meet at a vertex 257. As a result, inclined wedge surfaces 256 and 258 form straight planar, wedge surfaces. Wall panels 212 differ from wall panels 12 in that nose-shaped cut-out section 32 is replaced by a V-shaped cut-out section 232, in the same manner as discussed above in regard to FIG. 29.

During assembly at each corner, a first corner fastening extrusion 276 is secured to one wall 14*a* of existing wall structure 14 by screws 70 extending through openings 68 of the wing 66, such that the free end of base section 40 is in abutting relation to the other wall 14*b* of the corner which is perpendicular to wall 14*a*. In this arrangement, there is a space between the bent end securing wall 50 thereof and the parallel other wall 14*b*. A bent end section 18 is then press fit into this space, whereby the bent end securing wall 50 is biased away from the other wall 14*b* by engagement of the inner surface of bent end section 18 with inclined surface 256, until inclined wedge surface 236 passes vertex 257, whereby bent end securing wall 50 springs back to its original position, such that V-shaped inwardly directed projection 252 engages in V-shaped cut-out section 232. With this arrangement, bent end section 18 is held in position, while still permitting easy removal of bent end section 18 at a later time to remove the wall panel 12. In such position, outwardly extending stub walls 64 are preferably in abutting or near abutting relation with the respective planar main panel section 16.

In this position, the outer surface 30 of the bent end section 18 is in abutting or near abutting relation with the adjacent corner wall 14*b*, that is, it is at least in near abutting relation.

Then, a second corner fastening extrusion 276 is secured to the other wall 14*b* of existing wall structure 14 by screws 70 extending through openings 68 of the wing 66, such that the free end of base section 40 is in abutting relation to planar main panel section 16 of the already assembled wall panel 12. In this arrangement, there is a space between the bent end securing wall 50 thereof and planar main panel section 16 of the already assembled wall panel 12. A bent end section 18 of another wall panel 12 is then press fit into this space, whereby the bent end securing wall 50 is biased away from planar main panel section 16 of the already assembled wall panel 12 by engagement of the inner surface of bent end section 18 with inclined surface 256, until inclined wedge surface 236 passes vertex 257, whereby bent end securing wall 50 springs back to its original position, such that V-shaped inwardly directed projection 252 engages in V-shaped cut-out section 232. In such position, outwardly extending stub walls 64 are in abutting or near abutting relation with the respective planar main panel section 16.

In this position, the outer surface 30 of the bent end section 18 is in abutting or near abutting relation with the adjacent planar main panel section 16, that is, it is at least in near abutting relation.

It will be appreciated that the present invention can be varied within the scope of the claims. In all of the following embodiments, the bent end securing walls 50 are biased outwardly when the bent end sections 18 are pressed into engagement therewith, whereby the bent end securing walls 50 snap back and are then locked with the bent end sections 18, while also permitting later release and removal of the wall panels 212 by pulling wall panels 212 out, by using the inclined wedge surfaces.

Figure 32:
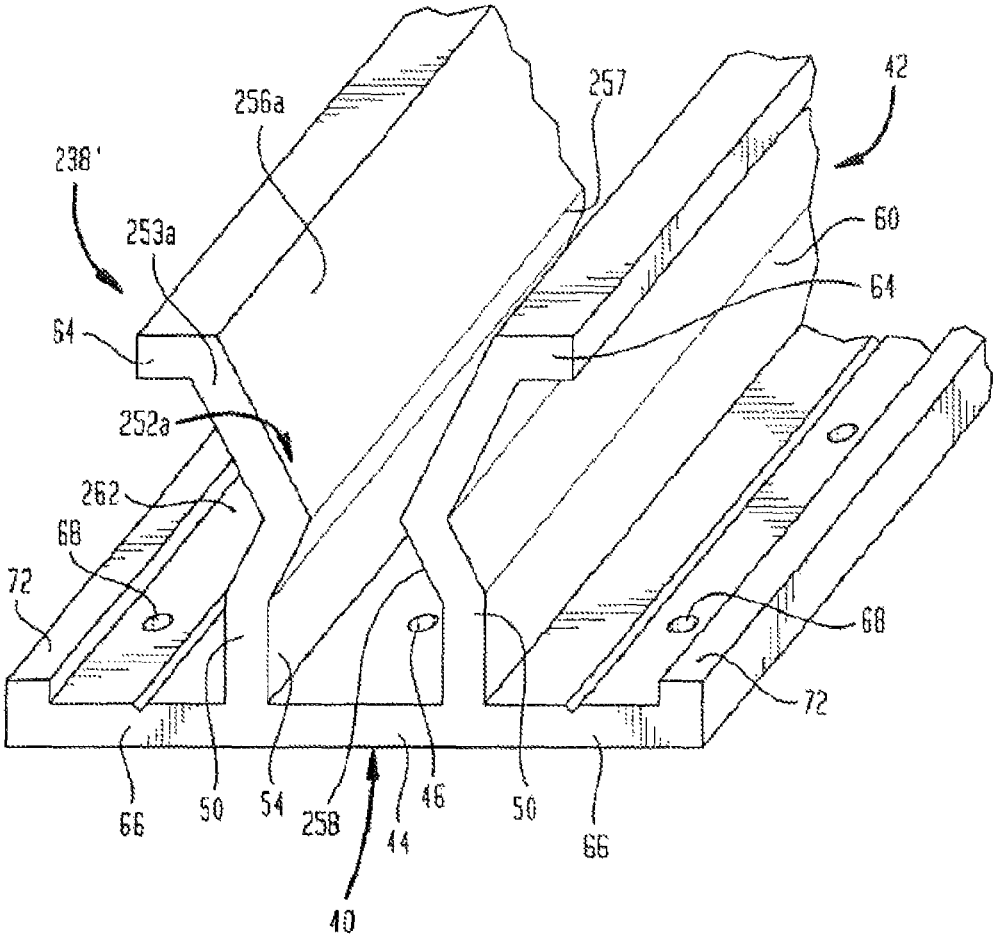
FIG. 32 is a perspective view of a frame extrusion according to another embodiment of the present invention.

Thus, FIG. 32 shows a modification of the embodiment of FIG. 2 in which the inclined surface 256*a* of each inwardly directed projection 252*a* of main fastening extrusion 238' continues upwardly at an angle with an inclined wall 253*a* and ends in outwardly extending stub wall 64 that is perpendicular to the respective bent end securing wall 50 and parallel to central planar wall 44, rather than changing direction and running parallel to each bent end securing wall 50. Preferably, although not required, outwardly extending stub wall 64 is in contact with the underside of planar main panel section 16 when inwardly directed projection 252*a* is positioned in cut-out section 32 so as to provide a snap-tight like action with a tight fit so that there is little or no play, whereby wall panels 12 are tightly held in position, while still permitting removal of wall panels 212 by reason of the aforementioned wedging action of the inclined wedge surfaces. Of course, it will be appreciated that outwardly extending stub walls 64 can be eliminated, and the free end of inclined wall 53*a* could be used to contact the underside of planar main panel section 16.

Figure 33:
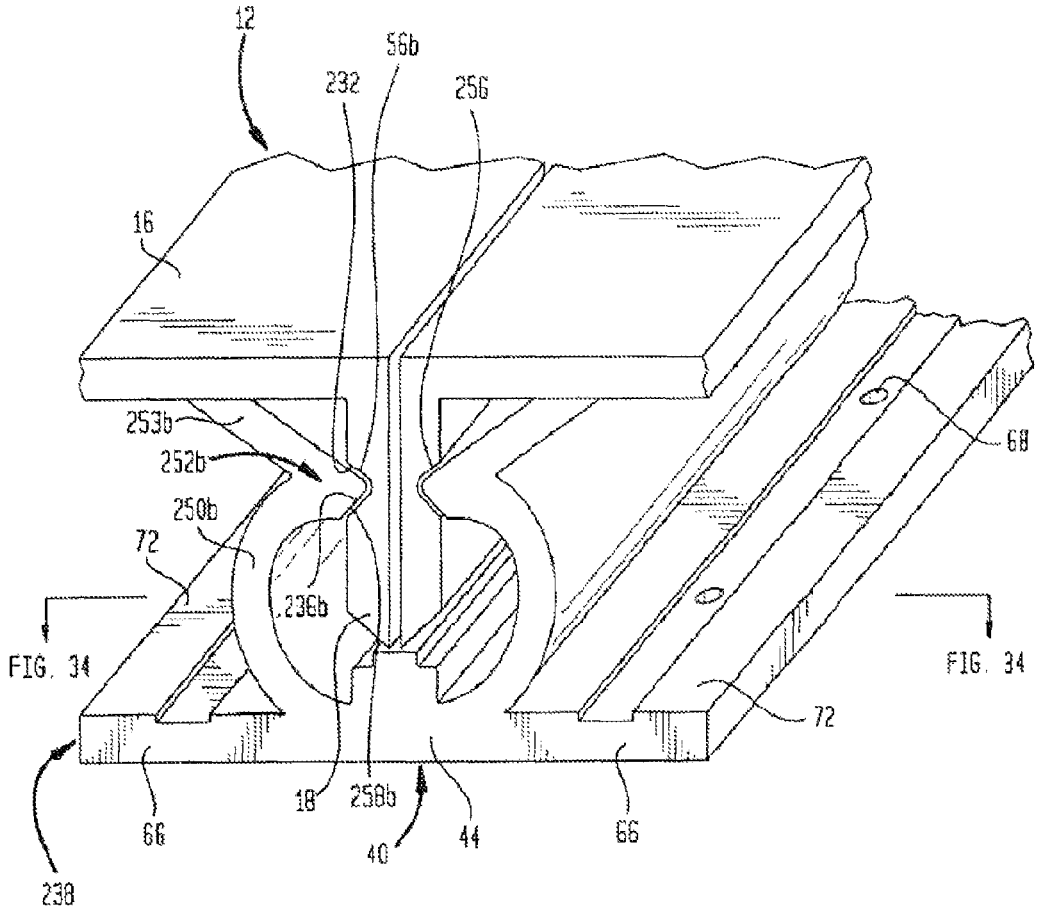
FIG. 33 is a perspective view showing two wall panels connected together by a frame extrusion according to another embodiment of the present invention.
Figure 34:
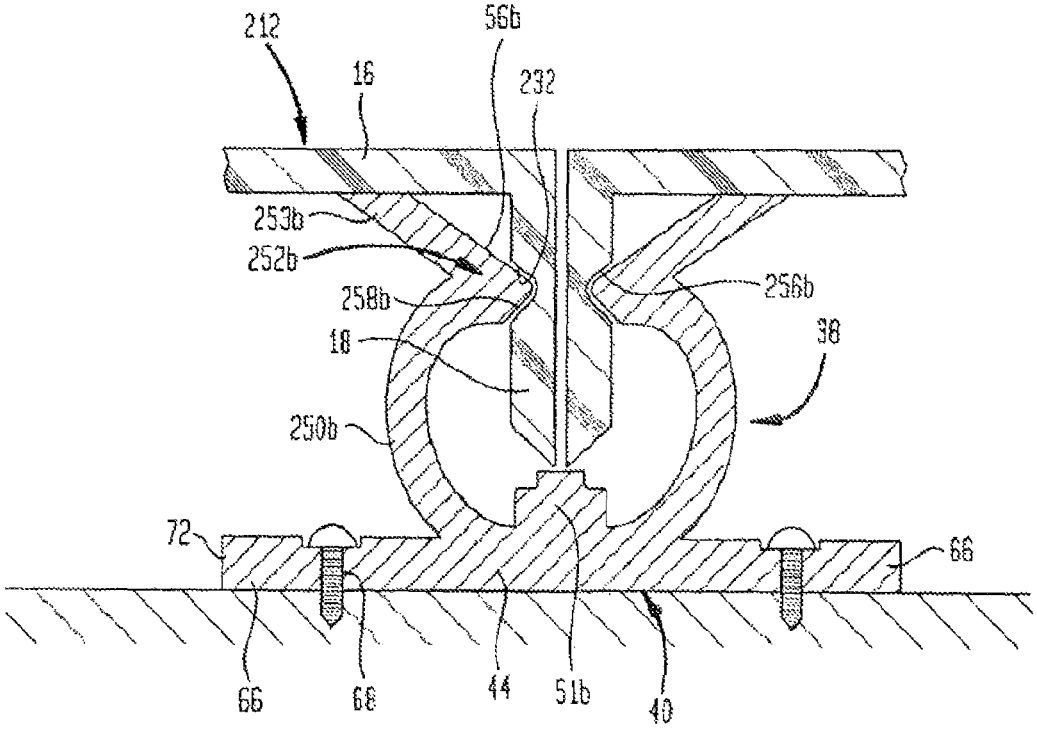
FIG. 34 is a cross-sectional view showing two wall panels connected together by the frame extrusion of FIG. 33.

FIGS. 33 and 34 correspond to the embodiment of FIGS. 7 and 8, except that holding surface 36 is replaced by a reverse inclined wedge surface 236*b* and holding surface 58 is replaced by a reverse inclined wedge surface 258*b* of main fastening extrusion 238". Thus, each bent end securing wall 250*b* has an outward curvature, terminating in an inwardly directed V-shaped projection 252*b* formed by inclined surface 256*b* and reverse inclined surface 258*b*. Further, the inclined surface 256*b* of each inwardly directed projection 252*b* continues upwardly at an angle with an inclined wall 253*b* that abuts against the inner surface or undersurface of planar main panel section 16 since the outwardly extending stub wall is eliminated. As with all other embodiment, bent end securing walls 250*b* are also flexible and resilient, so that they can be bent away from each other and when the bending force is removed, return to their original positions so that V-shaped inwardly directed projections 252*b* engage in V-shaped cut-out sections 232 in FIG. 33.

As will be appreciated from the latter embodiment, the two inwardly directed projections 52*b* have a spacing therebetween which is less than the wall thickness of two said bent end sections 18.

As with the embodiment of FIG. 32, preferably, a fit is obtained with little play. In both embodiments of FIG. 32 and FIGS. 33 and 34, and contrary to known arrangements, V-shaped cutouts 232 provide a sufficient recessed area to receive inwardly directed V-shaped projections 252, while also permitting inwardly directed V-shaped projections 252 to be pulled out therefrom due to the wedging action of reverse inclined wedge surfaces 236 and 258.

The following embodiments all include V-shaped cut-out section 232 with inclined wedge surfaces and corresponding V-shaped projections 252 with inclined wedge surfaces, except where otherwise indicated.

Figure 35:
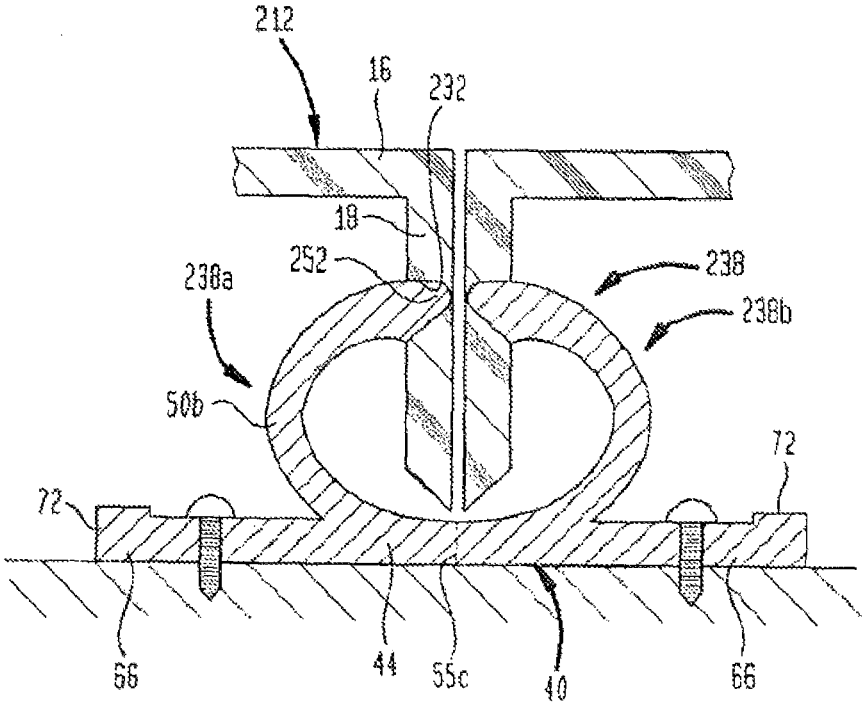
FIG. 35 is a cross-sectional view showing two wall panels connected together by a frame extrusion according to another embodiment of the present invention.

FIG. 35 shows a modification of the FIG. 33 embodiment in which platform 51*b* and inclined walls 53*b* are eliminated in main fastening extrusion sections 238*a* and 238*b*. In addition, as with all of the embodiments in the present application, main fastening extrusions 238 can each be formed as a unitary, one piece structure or of two separate main fastening extrusion sections 238*a* and 238*b* divided, as shown, by dashed line 55*c* in FIG. 35. Of course, V-shaped cut-outs 232 and V-shaped projections 252 are still provided with their inclined wedge surfaces.

Figure 36:
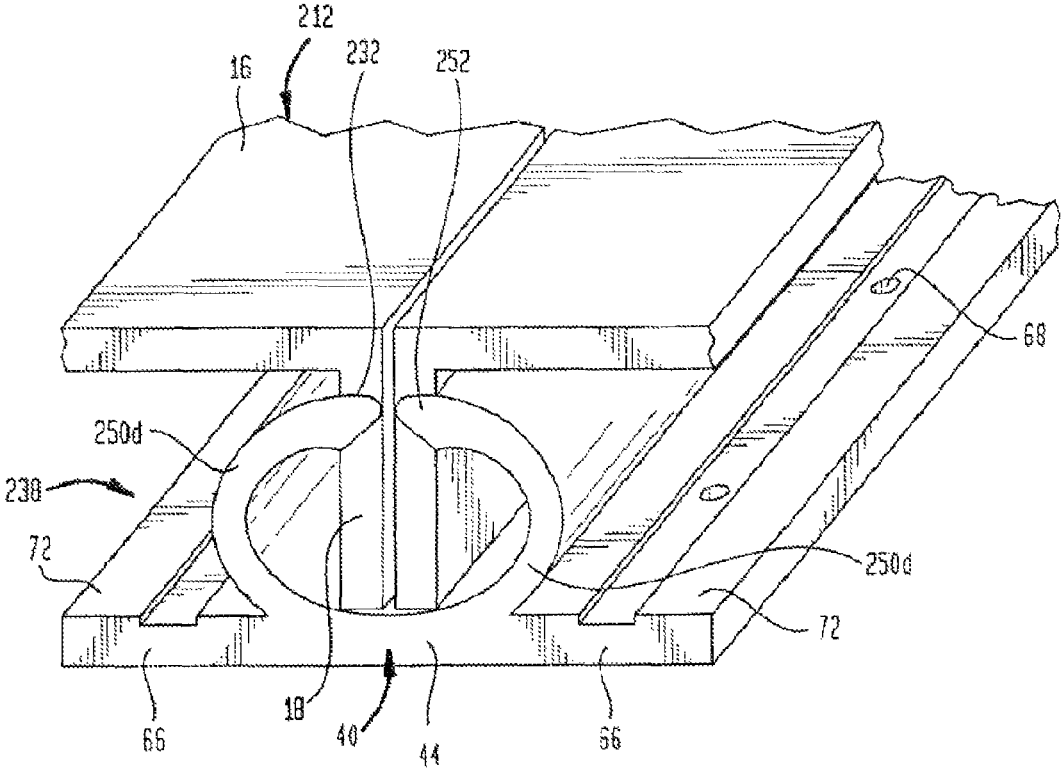
FIG. 36 is a perspective view showing two wall panels connected together by a frame extrusion according to another embodiment of the present invention.

FIG. 36 shows a modification of the FIG. 35 embodiment in which the only change has been changing the arc of outwardly curved bent end securing walls 250*d* so that the free ends form V-shaped projections 252 that engage in V-shaped cut-out sections 232 at positions close to the inner surfaces of bent end sections 18.

Figure 37:
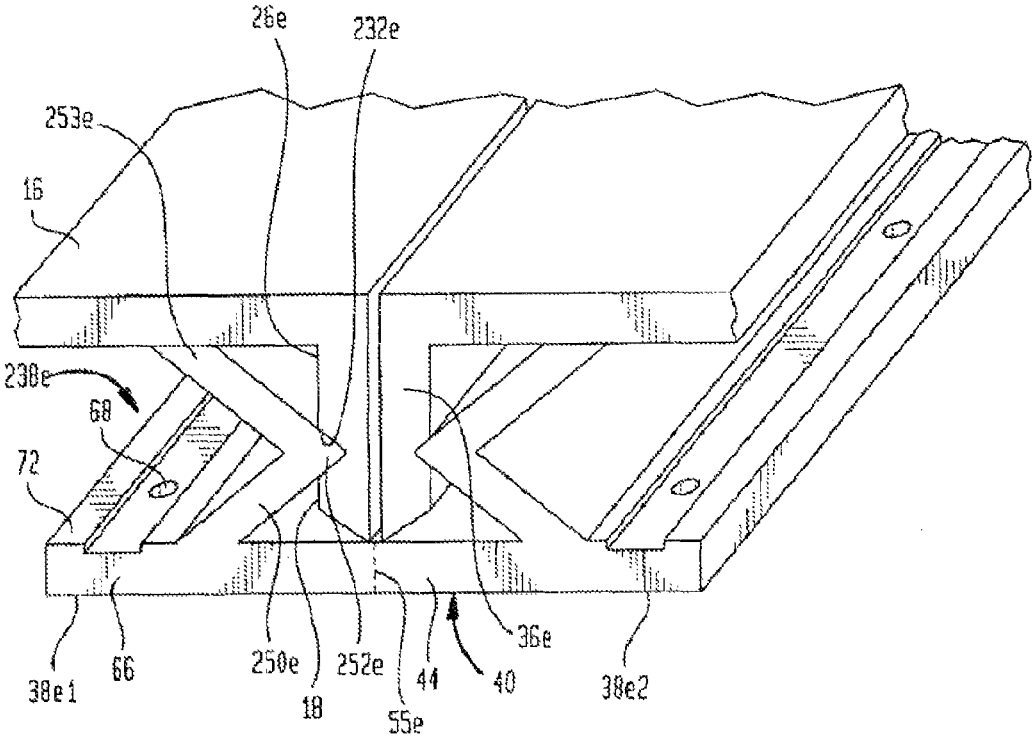
FIG. 37 is a perspective view showing two wall panels connected together by a frame extrusion according to another embodiment of the present invention.

FIG. 37 shows a modification of the FIGS. 32 and 33 embodiment in which the bent end securing walls 250*e* are inclined inwardly in an opposite direction from outwardly inclined wedge walls 253*e* and meet at a V-shaped inwardly directed projection 252*e* which is engaged in a V-shaped cut-out section 232*e*.

With this embodiment, pressing of bent end sections 18*e* into the spacing between bent end securing walls 250*e* of main fastening extrusion 238*e* causes bent end securing walls 250*e* to be biased away from each other until V-shaped projections 252*e* formed with the inclined wedge surfaces snap engage into respective V-shaped cut-out sections 232*e* formed with the inclined wedge surfaces, to releasably lock bent end sections 18*e* in the spacing in a manner that outer walls of bent end sections 18*e* are at least in near abutting relation with each other.

Figure 38:
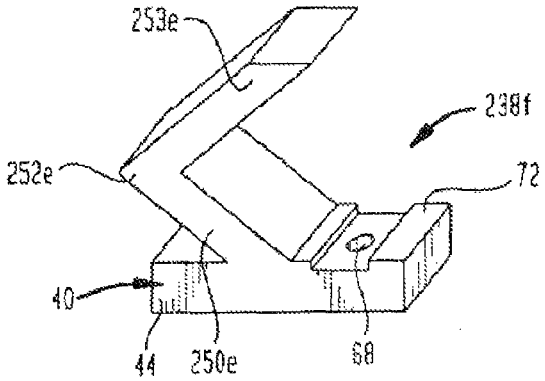
FIG. 38 is a perspective view of a frame extrusion according to another embodiment of the present invention.

As discussed above with respect to FIG. 35, main fastening extrusions 38*e* of FIG. 37 can each be formed as a unitary, one piece structure or of two separate main fastening extrusion sections 238*e*1 and 238*e*2 divided, as shown, by dashed line 55*c* in FIG. 37. In addition, each separate main fastening extrusion section 238*e*1 and 238*e*2 can be formed from a plurality of discrete main fastening extrusions 238*f*, as shown in FIG. 38, which are secured to the wall in parallel, spaced apart relation to each other. This applies to all of the embodiments of the present application.

Figure 39:
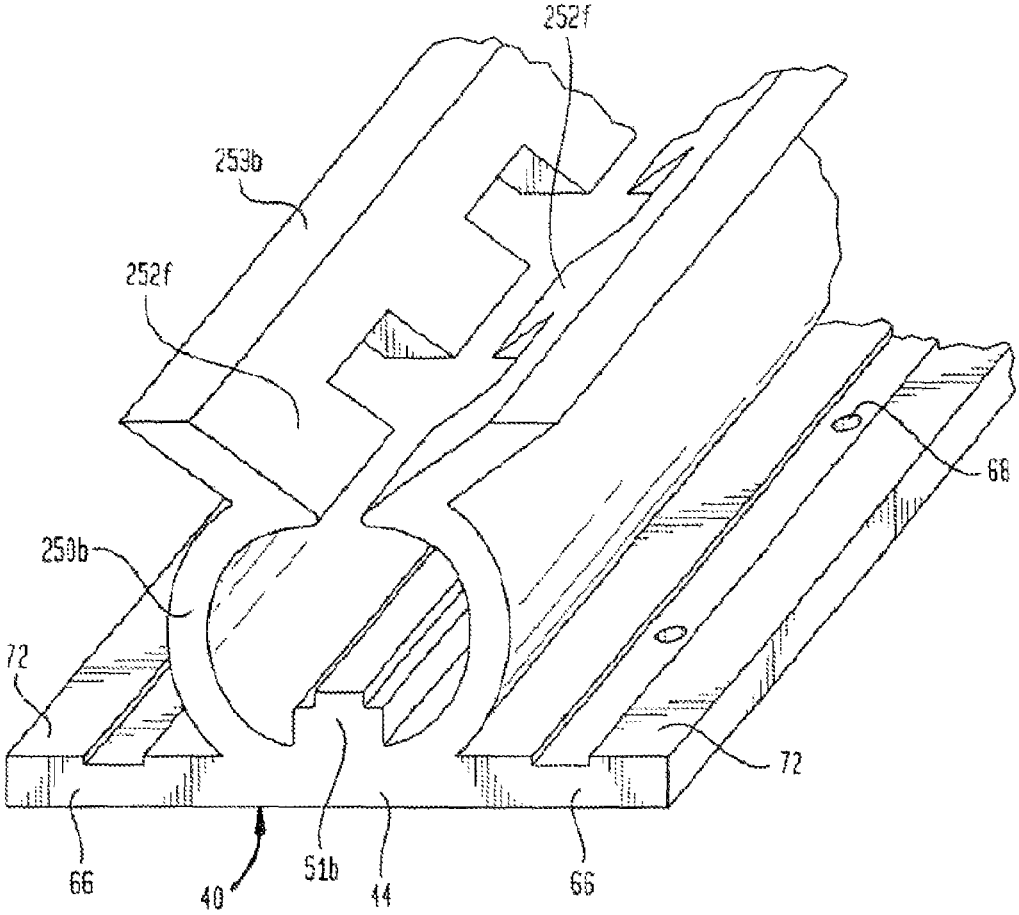
FIG. 39 is a perspective view of a frame extrusion according to another embodiment of the present invention.

It will be appreciated that, with the above embodiments, the respective V-shaped cut-out section 232 has been continuous. However, it is possible that a plurality of spaced apart V-shaped cut-out sections 232 can be provided along the length of bent end sections 18, and in such case, each inwardly directed V-shaped projection 252 would be formed of a plurality of spaced apart inwardly directed V-shaped teeth 252*f*, as shown in FIG. 39, which is a variation of the embodiment of FIGS. 33 and 34. This applies to all of the embodiments in the present application.

Figure 40:
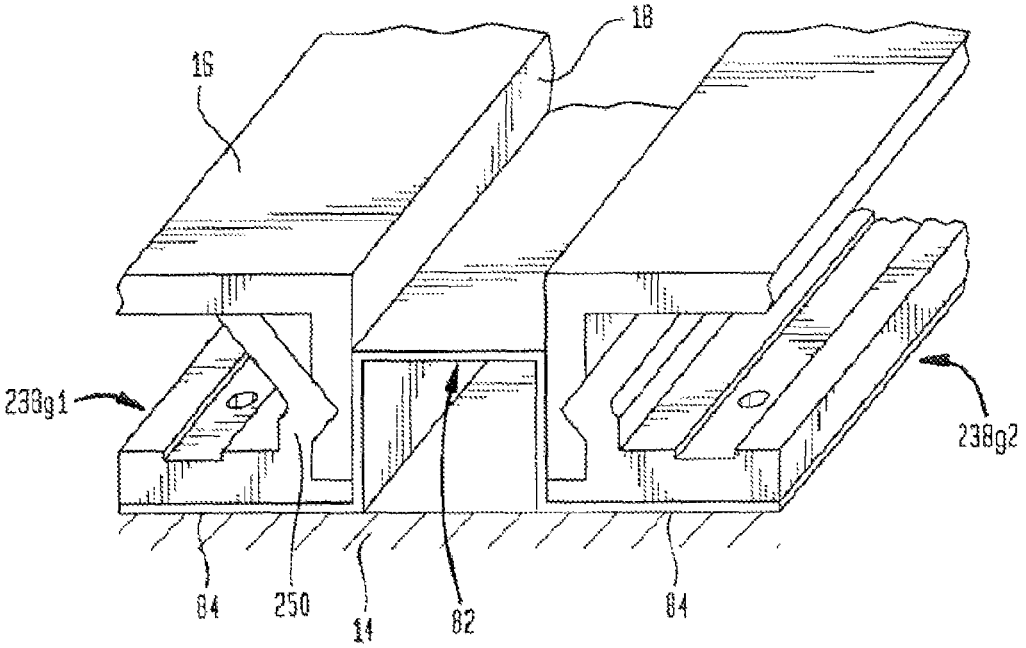
FIG. 40 is a perspective view showing two wall panels connected together by a frame extrusion according to another embodiment of the present invention.

Specifically, as shown in FIG. 40, two separate main fastening extrusion sections 238*g*1 and 238*g*2 are provided, which are of a similar configuration to the main fastening extrusion of FIG. 32, divided along a center line. In the embodiment of FIG. 40, a thin walled, inverted U-shaped spacer member 82 including outwardly extending wing sections 84 that extend between separate main fastening extrusion sections 38*g*1 and 38*g*2 and wall 14, is first secured to the wall 14 by any suitable means, for example, a double sided adhesive strip. Then, separate main fastening extrusion sections 238*g*1 and 238*g*2 are secured to wall 14 by screws, such that the inner surfaces of bent end securing walls 250 thereof are spaced away from the side edges of spacer member 82 by a distance equal substantially to the thickness of a bent end section 18.

Figure 40A:
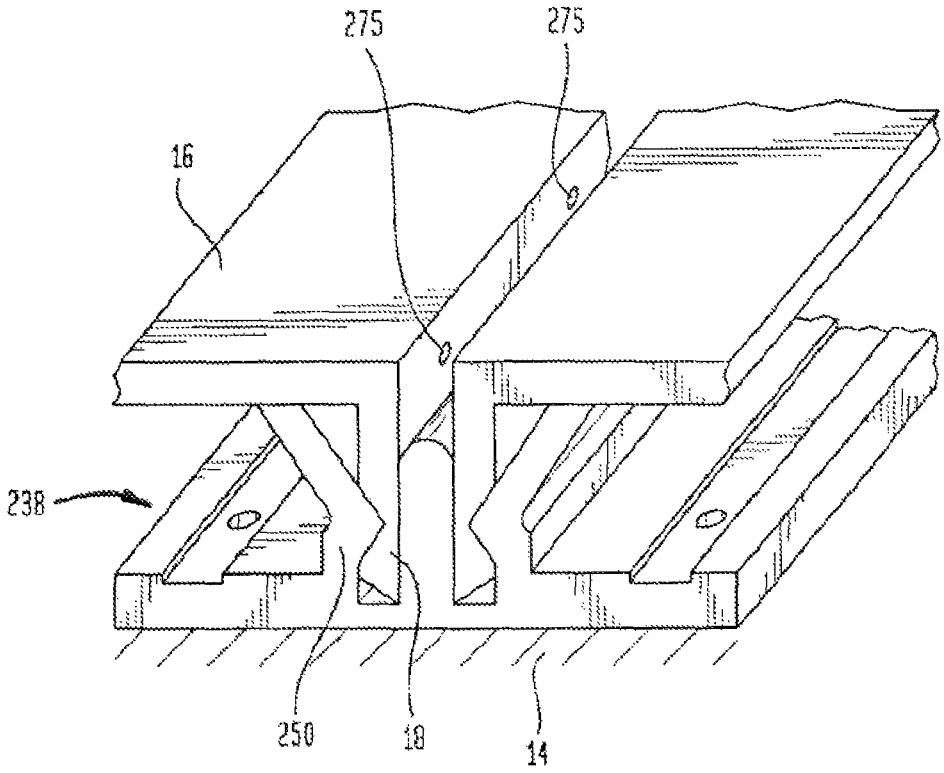
FIG. 40A is a perspective view showing two wall panels connected together by a frame extrusion according to another embodiment of the present invention.

FIG. 40A shows an embodiment similar to FIG. 40, except that U-shaped spacer member 82 is replaced by a spacer post member 282 that is formed integrally as a single piece with main fastening extrusion 238. In addition, holes 275 of any shape can be provided in the facing surfaces of bent end sections 18 so that a tool can be inserted therein to aid in pulling out the wall panels 12.

Figure 40B:
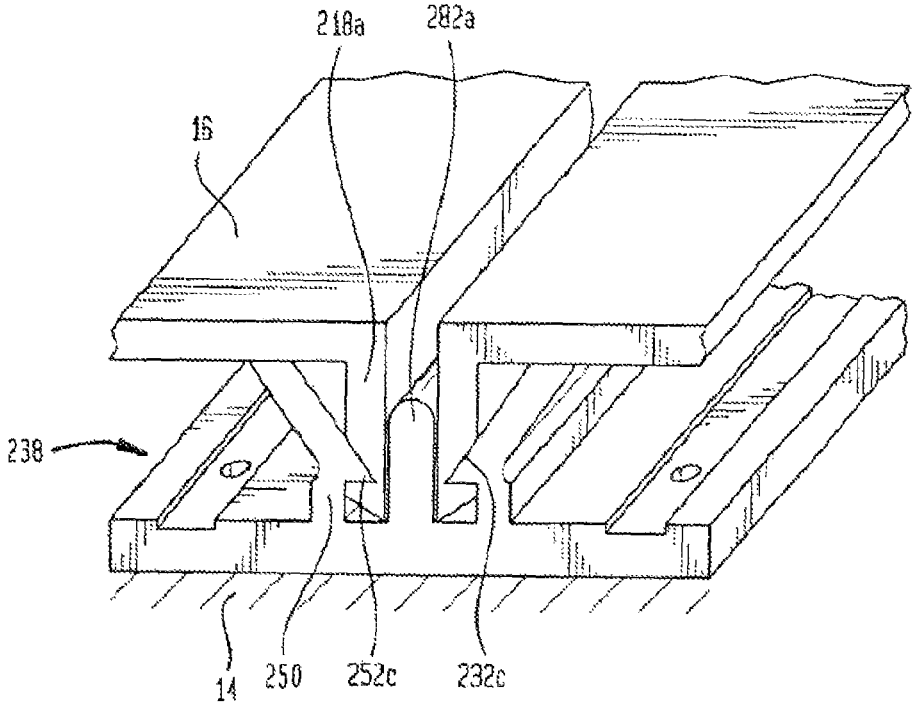
FIG. 40B is a perspective view showing two wall panels connected together by a frame extrusion according to another embodiment of the present invention.
Figure 40C:
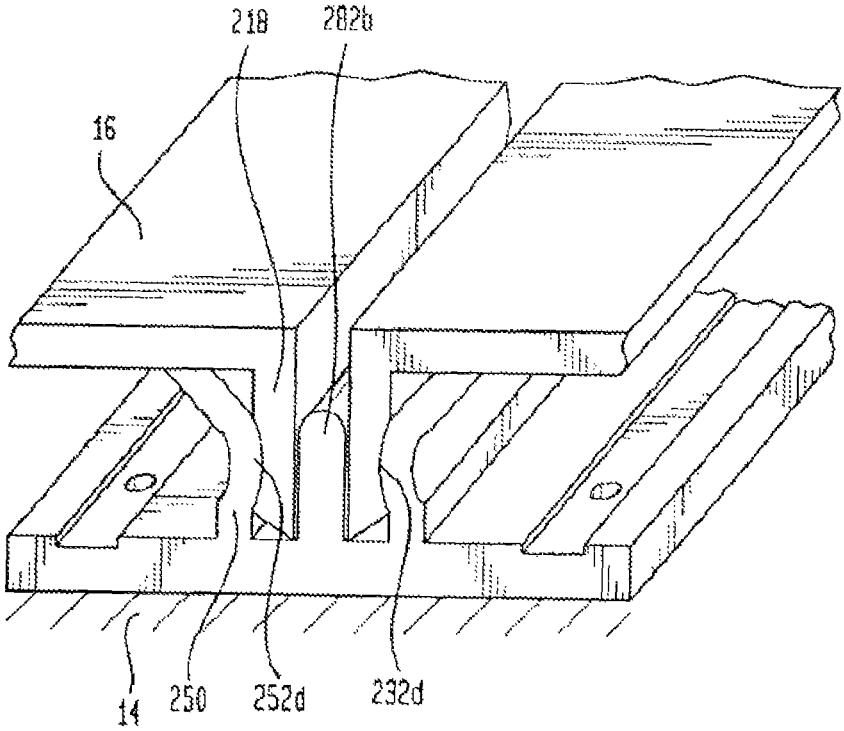
FIG. 40C is a perspective view showing two wall panels connected together by a frame extrusion according to another embodiment of the present invention.

FIGS. 40B and 40C show embodiments similar to FIG. 40A, with spacer post members 282*a* and 282*b*, respectively, in which FIG. 40B shows cut-outs 232*c* and projections 252*c* formed in a nose-shape similar to the embodiments of FIGS. 1-27, while FIG. 40C shows cut-outs 232*d* and projections 252*d* formed in an arcuate shape. The key aspect to these embodiments, as with the other embodiments, is that each bent end securing wall 250 is flexible and resilient so that, when a bent end section 218 is inserted into the space between the bent end securing wall 250 and the spacer post member 282, the bent end securing wall 250 will be biased away to allow the bent end section 218 to enter the space, whereupon the bent end securing wall 250, because of its resilience will resume its original unbiased position so that the projections are engaged in the cut-out sections.

Figure 40D:
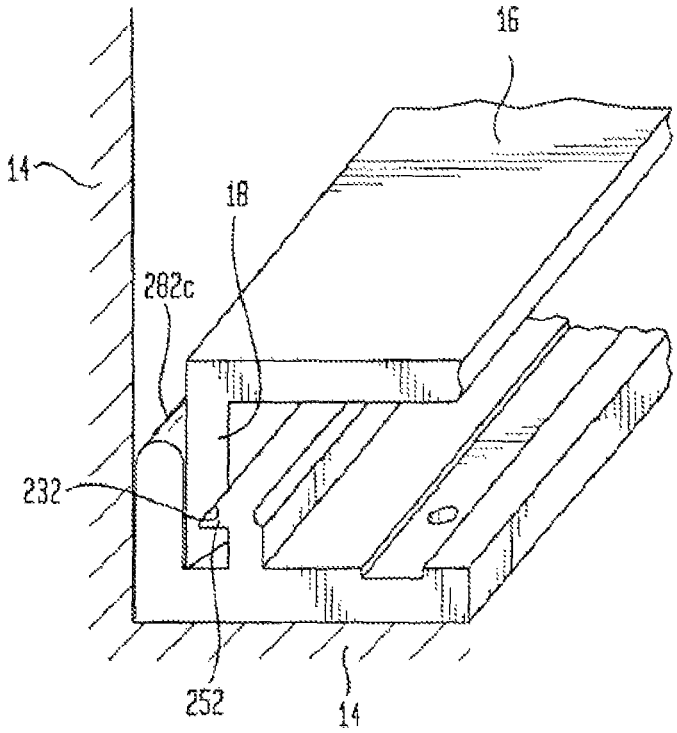
FIG. 40D is a perspective view showing two wall panels connected together by a frame extrusion according to another embodiment of the present invention.

FIG. 40D shows a variation of the embodiment of FIG. 40B for use in a corner. This is similar to the embodiment of 4, but rather than using the existing wall 14 to define the space for insertion of a bent end section 18, a spacer post member 282*c* is provided against the existing wall 14. This has the advantage of providing a more positive definition of the space for insertion of bent end section 18, as well as providing a more aesthetic look to conform to the spaces provided between wall panels 16 throughout the remainder of the wall.

Figure 40E:
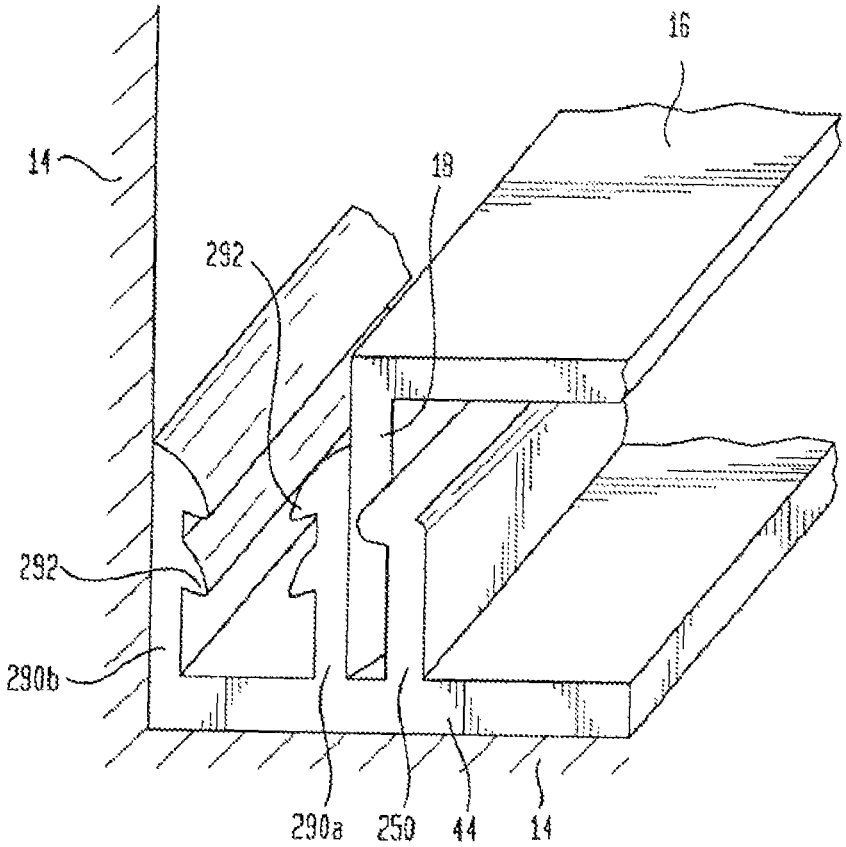
FIG. 40E is a perspective view showing two wall panels connected together by a frame extrusion according to another embodiment of the present invention.

FIG. 40E shows a variation of the embodiment of FIG. 40D, but with the spacer post member 282*c* replaced by second legs 290*a* and 290*b* with barbs 292 on the inner surfaces thereof that are angled toward base section 44. In this manner, a plug (not shown) can be inserted within the gap between second legs 290*a* and 290*b* for closing off the gap and providing an aesthetic appearance, with the plug engaged by barbs 292. Bent end section 18 is inserted into the space between second leg 290*a* and bent end securing wall 250 so as to deflect bent securing wall 250 in the manner discussed above.

Figure 41:
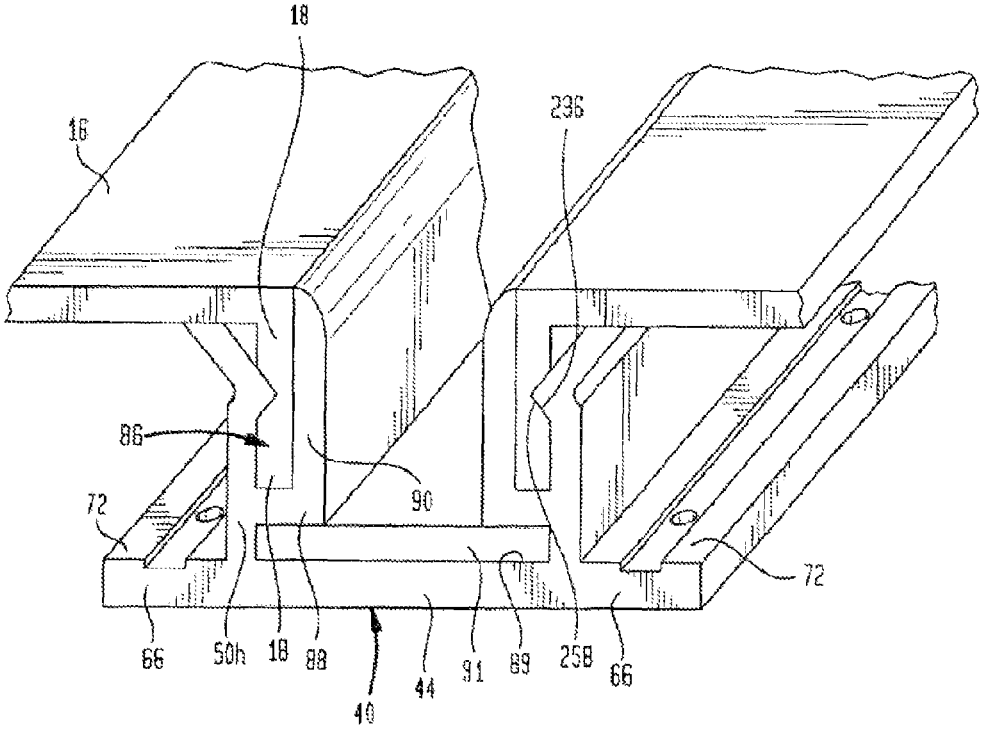
FIG. 41 is a perspective view showing two wall panels connected together by a frame extrusion according to another embodiment of the present invention.

FIG. 41 shows another embodiment which is identical to the embodiment of FIG. 18, except that holding surfaces 36 and 58 are replaced by reverse inclined wedge surfaces 236 and 258, respectively.

Figure 42:
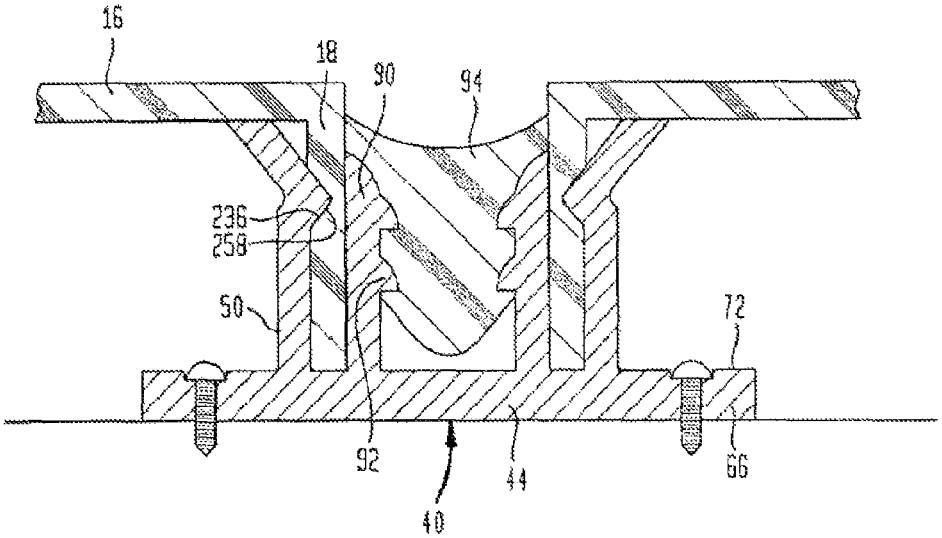
FIG. 42 is a cross-sectional view showing two wall panels connected together by a frame extrusion according to another embodiment of the present invention.

FIG. 42 shows another embodiment which is identical to the embodiment of FIG. 19, except that holding surfaces 36 and 58 are replaced by reverse inclined wedge surfaces 236 and 258, respectively.

Figure 42A:
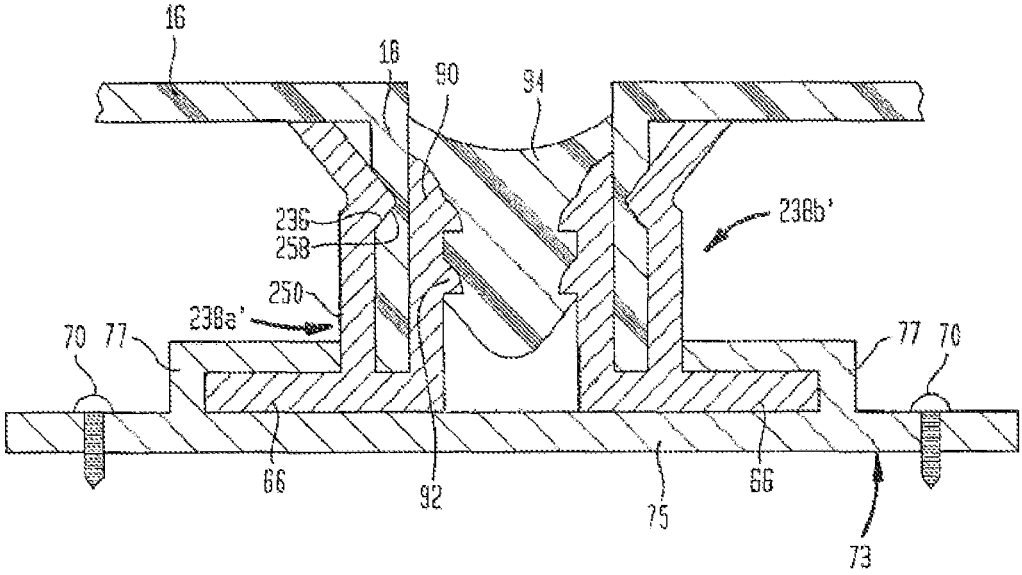
FIG. 42A is a cross-sectional view showing two wall panels connected together by a frame extrusion according to another embodiment of the present invention.

FIG. 42A shows a modification of the embodiment of FIG. 42 in which a separate base member 73 is first secured to a wall 14. Specifically, base member 73 includes a planar wall 75 that is secured to wall 14 by screws 70, with base member 73 including two inwardly directed L-shaped holding plates 77 extending therefrom in spaced relation to each other and facing each other. In this embodiment, main fastening extrusion 238 of FIG. 42 is separated into two fastening extrusions 238*a*= and 238*b*=, with wing walls 66 being inserted and captured within L-shaped holding plates 77. Thereafter, plug 94 can be inserted to maintain the spacing between main fastening extrusions 238*a*= and 238*b*=. Subsequently, it is only necessary to press fit bent end section 18 into the space between the respective bent end securing walls 250 and second legs 90.

Figure 42B:
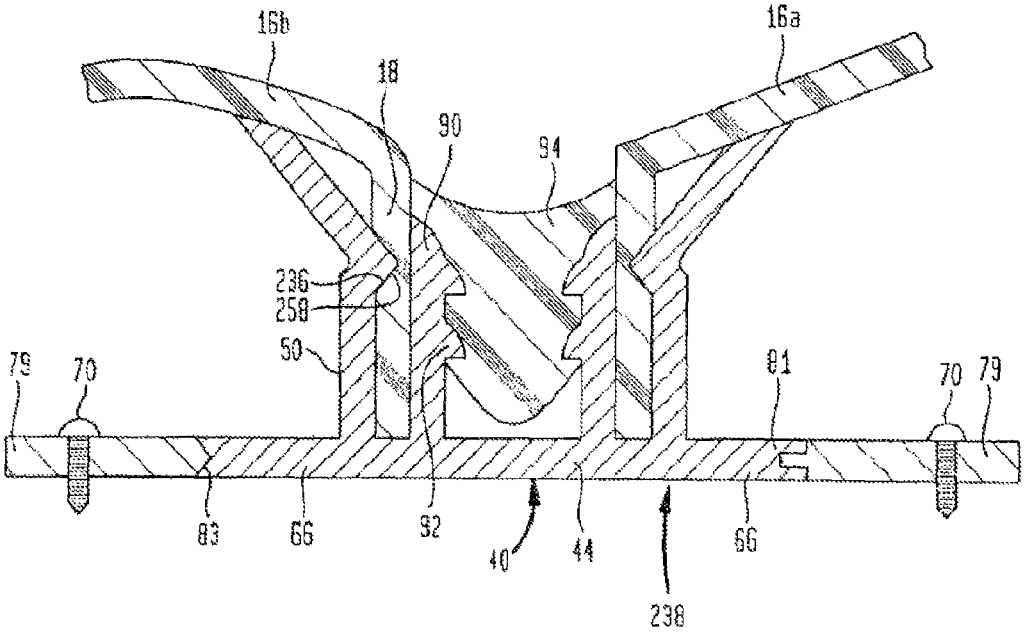
FIG. 42B is a cross-sectional view showing two wall panels connected together by a frame extrusion according to another embodiment of the present invention.

Alternatively, as shown in FIG. 42B, a separate securing wall 79 can be secured to wall 14 by screws 70 in abutting relation to the free end of a wing wall 66, and a locking arrangement can be provided for securing wing walls 66, and thereby main fastening extrusions 238, thereto. For example, this can include a tongue and groove arrangement 81 as shown at the right side of a FIG. 42B, a V-shaped end locking arrangement 83 as shown at the left side of FIG. 42B, or any other suitable arrangement. Further, as shown in FIG. 42B, main panel sections 16 of wall panels 12 do not have to be parallel to wall 14 and do not have to be planar, but can have other shapes, such as the angled main panel section 16*a* shown at the right side of FIG. 42B or the curved main panel section 16*b* shown at the left side of FIG. 42B. Alternatively, separate securing wall 79 can be eliminated, and main fastening extrusion 238 can be separated into two fastening extrusions 238*g*1 and 238*g*2 as in FIG. 40, but with inner edges of fastening extrusions 238*g*1 and 238*g*2 connected together by tongue and groove arrangement 81 or V-shaped locking arrangement 83.

Figure 42C:
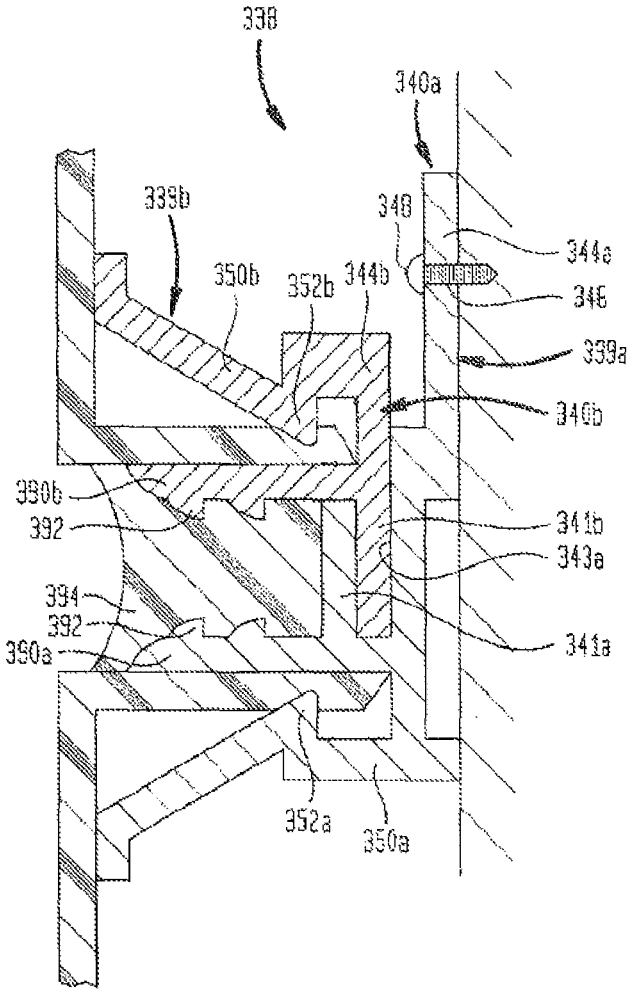
FIG. 42C is a cross-sectional view showing two wall panels connected together by a frame extrusion according to another embodiment of the present invention.

FIG. 42C shows a modification of the embodiment of FIG. 42A. In certain situations, it is difficult to secure the main fastening extrusion 238 to a wall. FIG. 42C provides a two piece arrangement of the main fastening extrusion that overcomes this problem. Specifically, as shown therein, main fastening extrusion 338 is provided with a first fastening section 339*a* having a base section 340*a* having a planar wall 344*a* that seats flush against existing wall structure 14, and which has a plurality of linearly aligned openings 346 extending therealong and through which screws 348 can be inserted to secure central wall panel 344 to existing wall structure 14. As with the embodiment of FIG. 19, the lower end of base section 340*a* has a bent end securing wall 350*a* extending outwardly therefrom, with a nose-shaped projection 352*a*, and a second leg 390*a* extending outwardly from base section 340*a* in parallel, spaced apart relation to bent end securing wall 350*a* by a spacing equal to or slightly greater than the width of a bent end section 18. This makes it easy to assemble first fastening section 339 to existing wall 14.

Main fastening extrusion 338 is provided with a second fastening section 339*b* which includes a base section 340*b* having a planar wall 344*b* with a second bent end securing wall 350*b* extending outwardly therefrom, with a nose-shaped projection 352*b*, and a second leg 390*b* extending outwardly from base section 340*b* in parallel, spaced apart relation to bent end securing wall 350*b* by a spacing equal to or slightly greater than the width of a bent end section 18.

First fastening section 339*a* includes a stub wall 341*a* that extends from first leg 390*a* toward second leg 390*b* in parallel, spaced apart relation from planar wall 344*a* so as to define a space or groove 343*a* therein, while second fastening section 339*b* includes a tongue wall 341*b* that extends from second leg 390*b* toward first leg 390*a* so as to slidably fit and be held within groove 343*a*, after first fastening section 339*a* is secured to wall 14. Thereafter, assembly of the wall panels is the same as discussed above in regard to FIG. 19.

In this regard bars 392 are provided on the inner facing surfaces of second legs 390*a* and 390*b* for holding a plug 394 therein.

Figure 43:
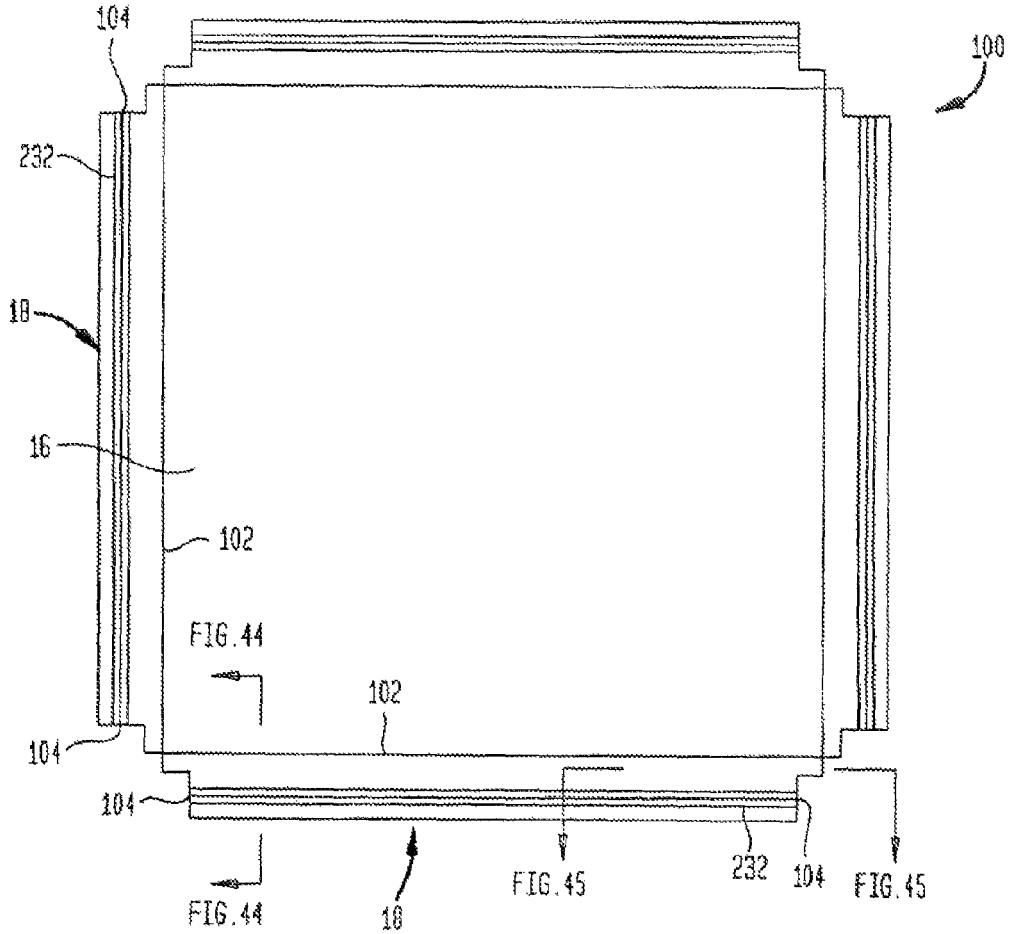
FIG. 43 is a top plan view of a planar blank used for forming a wall panel.
Figure 44:
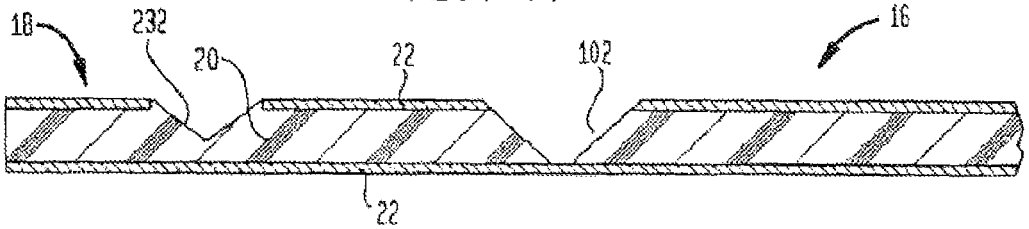
FIG. 44 is a cross-sectional view of the planar blank of FIG. 43, taken along line 44-44 thereof.
Figure 45:
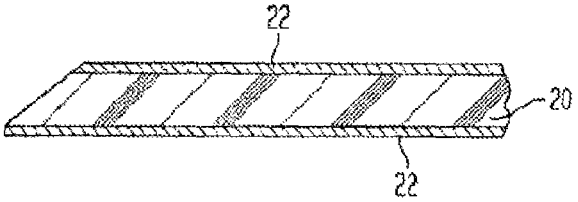
FIG. 45 is a cross-sectional view of the planar blank of FIG. 43, taken along line 45-45 thereof.

FIGS. 43-45 show another embodiment which is identical to the embodiment of FIGS. 20-22, except that cut-out section 32 is replaced by a V-shaped cut-out section 232. Of course, this embodiment would be used in the same arrangement as shown in FIG. 25A.

It will be further appreciated that, in accordance with the present invention, the V-shaped cut-out section 32, 232 can be provided in the inner facing surface of each bent end securing wall 50, 250, and the V-shaped projection 52, 252 can be provided in the corresponding facing surface of the bent end section 18 of the wall panel 12, 212, that is, a reversal of parts from that shown in the drawings.

It will be still further appreciated that, in each of the above embodiments, it is preferable that V-shaped cut-out sections 32, 232 extend through the outer facing thin aluminum wall 22 and through most or all of polyethylene core 20.

Figure 46:
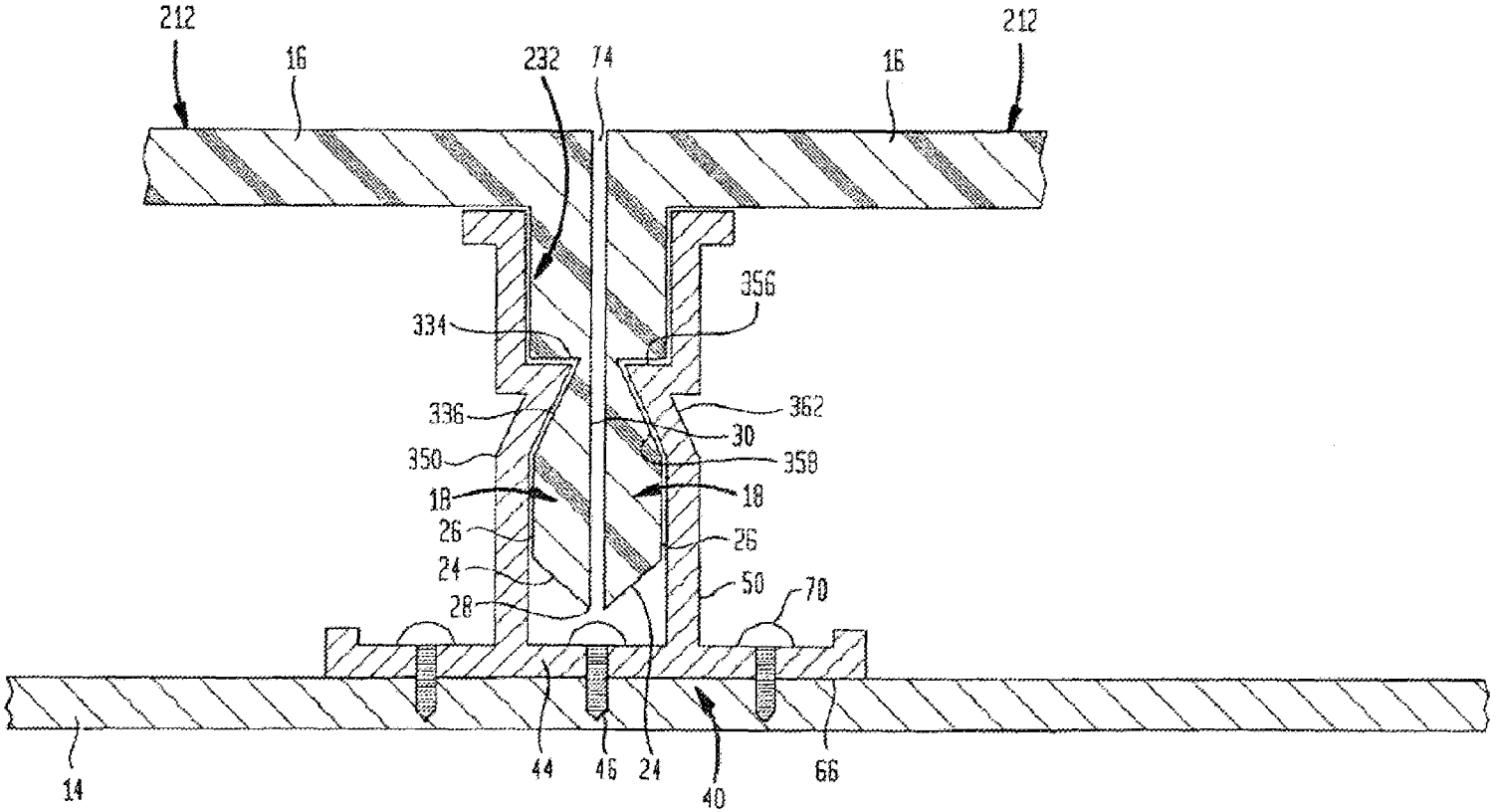
FIG. 46 is a cross-sectional view showing two wall panels connected together by a frame extrusion according to another embodiment of the present invention.

It will be appreciated that cut-out sections 232 and projections 252 need not have a V-shape, but can have any other suitable shape, as long as they include a reverse inclined wedge surface 236 and a reverse inclined wedge surface 258, respectively, to enable projection 252 to releasably lock in cut-out section 232, while also permitting disengagement thereof by a pulling action on the wall panels 212 when it is desired to change the wall panels 212. For example, as shown in FIG. 46, which corresponds to the embodiment of FIGS. 3 and 29, there are provided a reverse nose-shaped cut-out section 332 and a reverse nose-shaped projection 352 which retain the reverse inclined wedge surfaces 336 and 358, respectively to permit the wedging action for removal and replacement of wall panels 212. However, inclined wedge surface 234 is replaced by a planar surface 334 parallel to base section 40 and in like manner, inclined wedge surface 256 is replaced by a corresponding planar surface 356 of each bent end securing wall 350. A corresponding nose-shaped cut-out section 362 is also provided. Of course, it will be appreciated that because of the reverse orientation of nose-shaped cut-out section 332 and nose-shaped projection 352 from those of nose-shaped cut-out section 32 and nose-shaped projection 52 of FIG. 3, planar surfaces 334 and 356 do not constitute holding surfaces which would prevent the removal of the wall panels.

Figure 47:
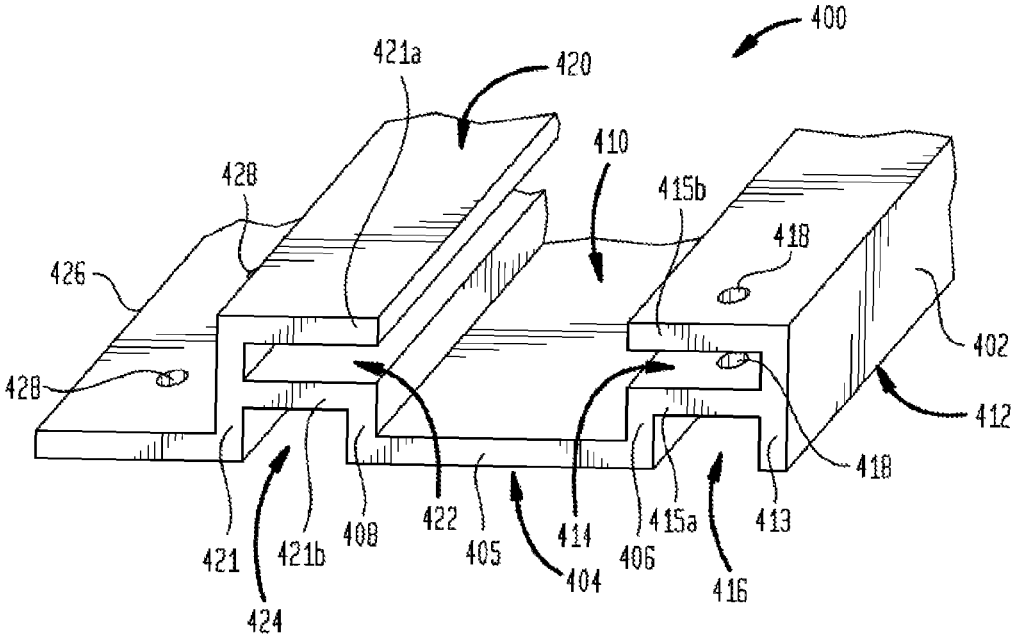
FIG. 47 is a perspective view of a frame extrusion in accordance with another embodiment of the present invention.

FIG. 47 shows a fastening extrusion 400 in the nature of a fastener in accordance with another embodiment of the present disclosure for attaching wall panels. The fastener extrusion 400 is particularly suitable for securing wall panels having L-shaped end sections as to be described hereinafter. The fastening extrusion may be formed as a one-piece, integral member 402 of suitable materials such as plastic or metal, e.g., aluminum. The member 402 may include a generally U-shaped base section 404 formed from a generally planar base wall 405 having first and second spaced apart upstanding walls 406, 408 forming an elongated opening 410 therebetween. A first U-shaped section 412 having an extended base wall 413 may be integrally coupled with the upstanding wall 406. An opening 414 is formed by a pair of preferably parallel spaced apart legs 415*a*, 415*b* of the U-shaped section 412. The opening 414 generally faces in the direction of wall 408 in communication with opening 410. Leg 415*a* and the extended base wall 413 of the U-Shaped section 412, along with the upstanding wall 406, form an opening 416 generally underlying opening 414 facing the supporting structure. One or more openings 418 may be provided in Legs 415*a*, 415*b* for receiving a fastener for securing a portion of a wall panel thereto as to be described hereinafter.

In a generally symmetrical arrangement, a second U-shaped section 420 having an extended base wall 421 is integrally coupled with the upstanding wall 408. The U-shaped section 420 has an opening 422 generally facing wall 406 and opposing opening 414. The opening 422 is formed by a pair of preferably parallel spaced apart legs 421*a*, 421*b* of the U-shaped section 420. The upstanding wall 408, along with the leg 421*b* and the extended base wall 421 of the U-Shaped section 420 form an opening 424 generally underlying opening 422. Openings 414 and 422 lie substantially in a common plane arranged above a plane containing opening 410 as further shown in FIG. 48. A securing section 426, generally in the nature of a planar member, is arranged integrally coupled to the extended base wall 421 so as to extend outwardly from the U-shaped member 420. The securing section 426 and the base wall 405 are generally arranged coplanar. The securing section 426 may be provided with a plurality of openings 428 to allow for securing of the fastening extrusion 400 to a supporting structure.

Figure 48:
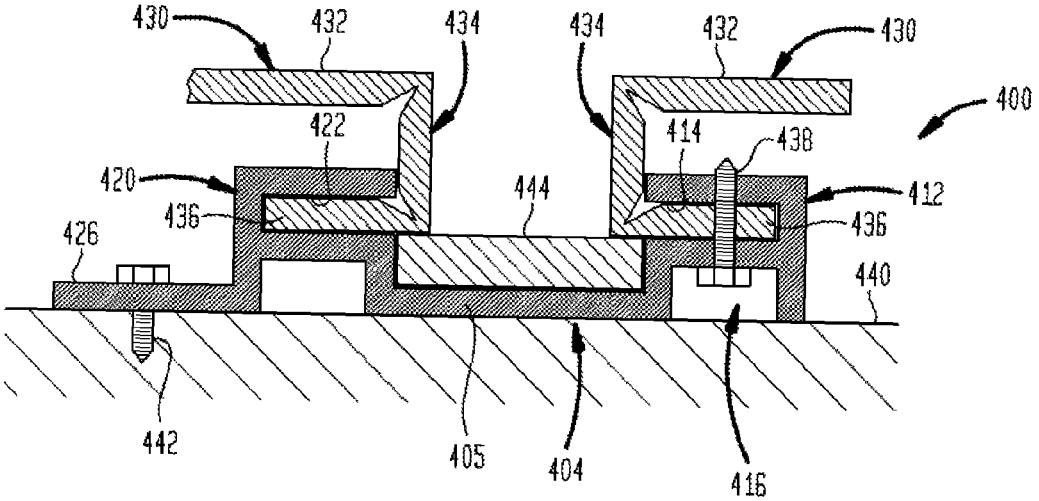
FIG. 48 is a cross sectional view showing two wall panels connected together by the frame extrusion of FIG. 47.

In FIG. 48, there is shown a plurality of wall panels 430 to be secured adjacent one another using a fastening extrusion 400. The wall panels 430 may be of similar material and construction as the wall panels previously described. Each of the wall panels 430 includes a main panel 432 and a plurality of L-shaped end sections 434 each further including an inwardly turned leg 436. The legs 436 are preferably arranged in parallel relationship to the main panel 432. Unlike the previously described wall panels, it is not required that wall panels 430 have a cut-out or recess section 32.

In assembling the system, a leg 436 of one wall panel 430 is initially inserted into the opening 414 of the U-shaped member 412. The leg may be secured to the U-shaped member 412 by means of a threaded fastener 438 such as a machine screw and the like. The fastener 438 extends through the aligned openings 418 if present within the U-shaped member 412 as it passes through leg 436. The head of the fastener 438 is received within opening 416. If no openings are provided, self-tapping screws and the like can be used to pierce the wall panel and the fastening extrusion. At this point, the fastening extrusion 400 can be positioned on a supporting surface 440 and secured thereto by similar fasteners 442 inserted into openings 428 if present in the securing section 426 or using self-tapping screws. As the fastening extrusion 400 is being positioned, the other opposing leg 436 of the wall panel 430 may be received within the opening 422 formed in the U-shaped section 420 of an adjacent fastening extrusion. FIG. 48 shows two adjacent wall panels 430 secured to the supporting surface 440 by a common fastening extrusion 400. This process can be repeated until a matrix of wall panels 430 are secured to the supporting surface 444 using a plurality of arranged fastening extrusions 400.

Optionally, the wall panel system can be further enhanced by inserting an elongated fillet 444 within the opening 410 of the U-shaped base section 404 along the length of the fastening extrusion 400. As shown, the fillet 444 is retained by a portion of the fillet being arranged underlying in near butting relationship the legs 436 of the L-shaped end sections 434 of the wall panels.

Figure 49:
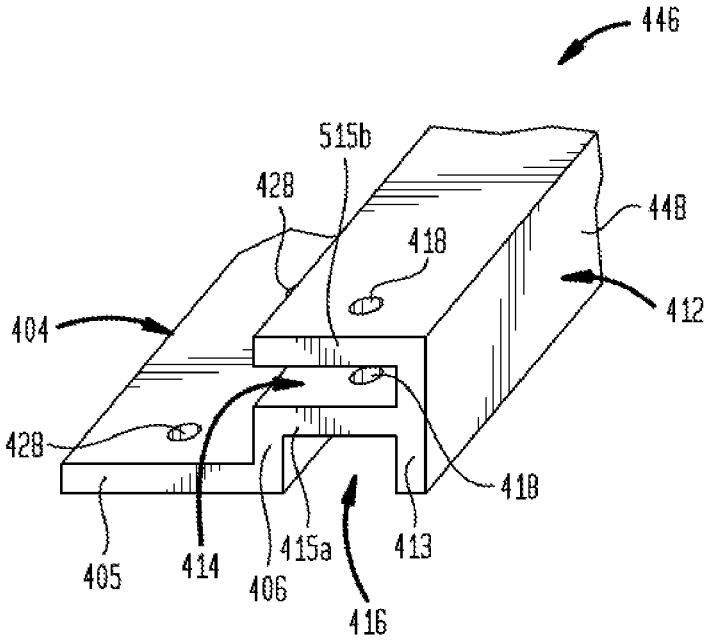
FIG. 49 is a perspective view of a corner frame extrusion according to another embodiment of the present invention.

FIG. 49 shows a corner fastening extrusion 446 adapted for use in securing a wall panel 430 adjacent the corner of a building wall structure 431. The corner fastening extrusion 446 has similar components and features as described with respect to fastening extrusion 400, wherein like reference numerals represent like elements. In this regard, the corner fastening extrusion may be formed as a one-piece integral member 448. More particularly, the corner fastening extrusion 446 includes only one U-shaped section 412 adapted to be arranged facing the building wall corner as to be described. The U-shaped section 412 may be integrally formed with the upstanding wall 406 and the base wall 405 of the base section 404 which may include a plurality of openings 428. The base wall 405 and upstanding wall 406 form a step. In this embodiment, the base section 404 functions as the securing section 426 previously described to enable securing the corner fastening extension 446 to a supporting surface.

Figure 50:
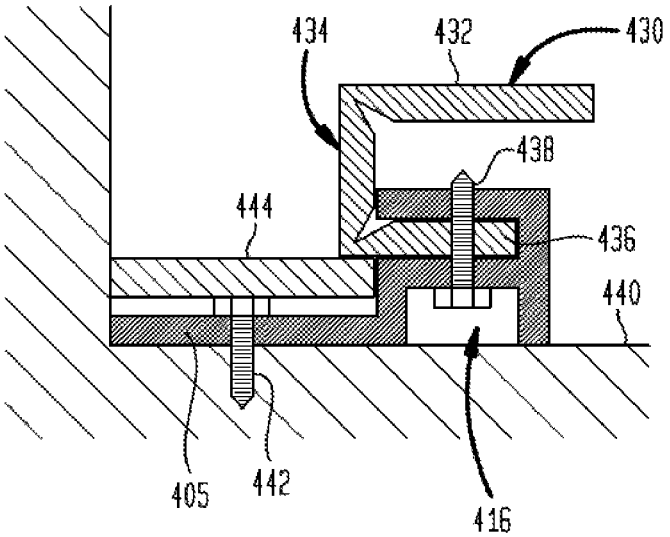
FIG. 50 is a cross sectional view showing a wall panel secured by the corner framer extrusion of FIG. 49.

As shown in FIG. 50, the leg 436 of the wall panel 430 is inserted into the opening 414 in the U-shaped section 412 and secured thereto via a fastener 438. The corner fastening extrusion 444 is thereafter positioned and secured to the supporting surface 440 adjacent the building wall corner via fasteners 442 extending through openings 428 if present in the base wall 405. Optionally, a fillet 444 may be inserted overlying the base wall 405, having a portion thereof underlying the leg 436 of the L-shaped end section 434.

Having described specific preferred embodiments of the disclosure with reference to the accompanying drawings, it will be appreciated that the present disclosure is not limited to those precise embodiments and that various changes and modifications can be effected therein by one of ordinary skill in the art without departing from the scope or spirit of the disclosure as defined by the appended claims.

The invention claimed is:

1. A fastener for attaching a wall panel to a supporting structure, the fastener comprising:

a U-shaped base section having first and second spaced apart upstanding walls forming a first opening extending therebetween;

a first U-shaped section arranged at the first upstanding wall having a second opening facing the second upstanding wall, the first U-shaped section including a pair of parallel spaced apart legs connected by a first base wall forming the second opening, and the first U-shaped section having coplanar with the first base wall a first extended base wall;

a second U-shaped section arranged at the second upstanding wall having a third opening facing the first upstanding wall, the second U-shaped section including a pair of parallel spaced apart legs connected by a second base wall forming the third opening, and the second U-shaped section having coplanar with the second base wall a second extended base wall, wherein the second and third openings are arranged opposing each other; and a securing section arranged outwardly of the second U-shaped section adapted for attaching the fastener to the supporting structure;

wherein the first upstanding wall, the first extended base wall and one leg of the first U-shaped section form a fourth opening underlying the second opening; and the second upstanding wall, the second extended base wall and one leg of the second U-shaped section forming a fifth opening underlying the third opening, and wherein the base section, the first and second U-shaped sections, and the securing section are a one piece integral member.

2. The fastener of claim 1, wherein the second and third openings are arranged in a common plane above a plane containing the first opening.

3. The fastener of claim 1, further including a fillet configured to be received within the first opening.

4. The fastener of claim 1, wherein one leg of the first U-shaped section and one leg of the second U-shaped section each have an end opposing each other in a common plane.

5. The fastener of claim 4, wherein another leg of the first U-shaped section and another leg of the second U-shaped section each have an end opposing each other in a common plane.

6. A fastener for attaching a wall panel having L-shaped end sections to a supporting structure, the fastener comprising:

a U-shaped base section having first and second spaced apart upstanding walls forming a first opening extending therebetween;

a first U-shaped section integral as one piece with the first upstanding wall and having a second opening facing the second upstanding wall, the first U-shaped section including a pair of parallel spaced apart legs connected by a first base wall forming the second opening, and the first U-shaped section having coplanar with the first base wall a first extended base wall, the second opening arranged above the first opening in communication therewith, the second opening configured to receive a portion of an L-shaped end section of a wall panel;

a second U-shaped section integral as one piece with the second upstanding wall and having a third opening facing the first upstanding wall, the second U-shaped section including a pair of parallel spaced apart legs connected by a second base wall forming the third opening, and the second U-shaped section having coplanar with the second base wall a second extended base wall, the third opening arranged above the first opening in communication therewith, the third opening configured to receive a portion of another L-shaped end section of another wall panel; and a securing section integral as one piece with the second extended base wall of the second U-shaped section adapted for attaching the fastener to the supporting structure;

wherein the first extended base wall, one leg of the first U-shaped section and the first upstanding wall form a fourth opening underlying the second opening; and the second extended base wall, one leg of the second U-shaped section and the second upstanding wall form a fifth opening underlying the third opening.

7. The fastener of claim 6, wherein the second and third openings are arranged in a common plane above a plane containing the first opening.

8. The fastener of claim 7, wherein the base section, first and second U-shaped sections, and securing section are a one piece integral member.

9. The fastener of claim 6, further including a fillet configured to be received within the first opening.

10. The fastener of claim 6, wherein one leg of the first U-shaped section and one leg of the second U-shaped section each have an end opposing each other in a common plane.

11. The fastener of claim 10, wherein another leg of the first U-shaped section and another leg of the second U-shaped section each have an end opposing each other in a common plane.

12. A system including a plurality of fasteners for attaching a plurality of wall panels to a supporting structure, the system comprising:

the plurality of wall panels each having an L-shaped end section; and the plurality of fasteners each comprising:

a base section having spaced apart ends and an upstanding wall at at least one end of the base section forming a step thereat; and a U-shaped section integrally coupled to the upstanding wall, the U-shaped section having a first opening facing the base section, the U-shaped section including a pair of parallel spaced apart legs forming the first opening therebetween, the pair of legs connected by a base wall having coplanar therewith an extended base wall, the extended base wall, one leg of the U-shaped section and the upstanding wall forming a second opening underlying the first opening;

wherein the first opening is configured to receive a portion of the L-shaped end section of the wall panel; and wherein the base section and the U-shaped section comprise a one piece integral member.

13. The system of claim 12, further including a fillet configured to be received overlying the base section between the spaced apart ends.

14. A system for mounting a plurality of wall panels to a supporting structure, the system comprising:

the plurality of wall panels including a main panel and at least one L-shaped end section arranged at a right angle to the main panel;

a plurality of fasteners for attaching a plurality of wall panels to the supporting structure, the fasteners comprising:

a U-shaped base section having first and second spaced apart upstanding walls forming a first opening extending therebetween;

a first U-shaped section arranged at the first upstanding wall having a second opening facing the second upstanding wall, the first U-shaped section including a pair of spaced apart legs connected by a first base wall having coplanar therewith a first extended base wall, the second opening configured to receive a portion of an L-shaped end section of a wall panel;

a second U-shaped section arranged at the second upstanding wall having a third opening facing the first upstanding wall, the second U-shaped section including a pair of spaced apart legs connected by a second base wall having coplanar therewith a second extended base wall, the third opening configured to receive a portion of an L-shaped end section of another wall panel;

a securing section arranged outwardly of the second U-shaped section adapted for attaching the fastener to a supporting structure; and a fillet configured to be received within the first opening;

wherein the first extended base wall, one leg of the first U-shaped section and the first upstanding wall form a fourth opening underlying the second opening; and the second extended base wall, one leg of the second U-shaped section and the second upstanding wall form a fifth opening underlying the third opening, wherein the fourth and fifth openings are configured to face the supporting structure.

15. The system of claim 14, wherein the first and second U-shaped sections and the securing section are integrally coupled to the base section as a one-piece member.

16. The system of claim 14, wherein the fillet is arranged underlying a portion of the L-shaped end sections of a pair of adjacent wall panels.

17. The system of claim 14, wherein the securing section and the base section are arranged in a common plane.

18. The system of claim 14, wherein the pair of spaced apart legs of the first and second U-shaped sections form the second and third openings respectively.

* * * * *